US012168869B2

(12) United States Patent
Mattsson et al.

(10) Patent No.: US 12,168,869 B2
(45) Date of Patent: Dec. 17, 2024

(54) OFFICE POD AND A SOUNDPROOFING WALL STRUCTURE

(71) Applicant: FRAMERY OY, Tampere (FI)

(72) Inventors: Markus Mattsson, Kiruna (SE); Miika Hällfors, Valkeakoski (FI)

(73) Assignee: FRAMERY OY, Tampere (FI)

( * ) Notice: Subject to any disclaimer, the term of this patent is extended or adjusted under 35 U.S.C. 154(b) by 0 days.

(21) Appl. No.: 18/517,132

(22) Filed: Nov. 22, 2023

(65) Prior Publication Data

US 2024/0175257 A1 May 30, 2024

(30) Foreign Application Priority Data

Nov. 25, 2022 (EP) ..... 22209635
Nov. 25, 2022 (FI) ..... 20226054

(51) Int. Cl.
*E04B 1/82* (2006.01)

(52) U.S. Cl.
CPC ..... *E04B 1/8218* (2013.01)

(58) Field of Classification Search
CPC ..... E04B 1/8218; E04B 1/8409; E04B 1/86; E04H 1/14; E04H 1/125
See application file for complete search history.

(56) References Cited

U.S. PATENT DOCUMENTS 3,422,921 A * 1/1969 Warnaka ..... E04B 1/86 181/286
10,418,017 B1 * 9/2019 Keeley ..... F16B 1/00
2003/0024172 A1 * 2/2003 Lyons ..... A62C 3/16 52/267
2004/0065501 A1 * 4/2004 Tong ..... G10K 11/168 181/290
2014/0137495 A1 5/2014 Ariza et al.
2020/0324515 A1 * 10/2020 Hällfors ..... E04B 1/8218
2021/0285230 A1 * 9/2021 Baert ..... E04F 15/102
2022/0028363 A1 * 1/2022 Koshitouge ..... G10K 11/168
2022/0076653 A1 * 3/2022 Matsumoto ..... G10K 11/168
2022/0268029 A1 * 8/2022 Barras Carapinha ... E04B 9/045
2023/0022370 A1 * 1/2023 Kabatsi ..... B41M 1/28

FOREIGN PATENT DOCUMENTS

AU 6173799 A 2/2000
CH 407489 A 2/1966
CN 1109196 A 9/1995
CN 104379849 A 2/2015
CN 108431341 A 8/2018
(Continued)

OTHER PUBLICATIONS

Finnish Patent and Registration Office, Allowable text accompanying Communication of Acceptance dated May 17, 2024, FI Application 20226054, dated Aug. 16, 2023, 56 pages.
(Continued)

*Primary Examiner* — Christine T Cajilig
(74) *Attorney, Agent, or Firm* — Ziegler IP Law Group LLC.

(57) ABSTRACT

An office pod enclosing a soundproof workspace inside of the pod, comprising a wall structure formed of a sound absorbing element and a skin layer, wherein the skin layer has a coincidence frequency outside of a predetermined human speech frequency region.

13 Claims, 18 Drawing Sheets

(56) References Cited

FOREIGN PATENT DOCUMENTS

| | | | | |
|---|---|---|---|---|
| CN | 111305405 | A | 6/2020 | |
| FR | 2733261 | A1 | 10/1996 | |
| WO | WO-2017134341 | A1 * | 8/2017 | ..... B32B 15/046 |
| WO | WO-2018011462 | A1 * | 1/2018 | ..... E04B 1/8218 |
| WO | WO-2022084582 | A1 * | 4/2022 | ..... A47B 21/06 |

OTHER PUBLICATIONS

Finnish Patnet and Registration Office, Communication of Acceptance, Application No. 20226054, Issued May 15, 2024, 6 Pages.
Alba et al., "Electroacoustic method for meausring air-flow resistivity in a standing wave tube" In: inter.noise 2019, Noise control for a better environment Jun. 2019, 11 pages.
European Patent Office, Extended European Search Report, Application No. 22209635.6, mailed May 3, 2023, 7 pages.
Finnish Patent and Registrtion Office, First Opinion on Patentability, Application No. 20226054, mailed Mar. 1, 2023, 9 pages.
Chinese Patent Office, Office Action, Application No. 202311539224.5, Publication Date Jun. 21, 2024, 7 Pages.

* cited by examiner

OFFICE POD AND A SOUNDPROOFING WALL STRUCTURE

FIELD

The present disclosure generally relates to office pods or similar.

BACKGROUND

This section illustrates useful background information without admission of any technique described herein representative of the state of the art.

Office pods, such as soundproof meeting, working or phone booths, are increasingly used in modern furnishing of workplaces as well as public spaces. Such pods are often used for working, meetings, telephone calls and video conferencing.

A conventional office pod comprises opposite wall modules connected to each other by a floor module at the bottom and a ceiling module at the top. These modules form a rigid chassis to which window and/or door frames are attached at sides. The wall modules comprise alternating sound stopping and sound absorbing layers, and an exterior cover (skin layer) at an outermost layer.

In recent times, these kinds of office pods are increasingly more expensive to manufacture.

SUMMARY

It is an object of certain embodiments of the present disclosure to provide a novel and inventive office pod of new design and a novel and inventive soundproofing wall structure.

According to a first example aspect of the present disclosure there is provided an office pod enclosing a soundproof workspace inside of the pod, comprising:

a wall structure formed of a sound absorbing element and a skin layer, wherein the skin layer has a coincidence frequency outside of a predetermined human speech frequency region.

In certain embodiments, the coincidence frequency of the skin layer is above said predetermined human speech frequency region so as to improve a sound stopping effect at human speech frequencies.

In certain embodiments, the office pod comprises said skin layer having a coincidence frequency outside of said predetermined human speech frequency region defined based on frequencies at which human speech has the greatest intensity.

In certain embodiments, said predetermined human speech frequency region is defined based on frequencies at which human speech carries the most information in a spoken content.

In certain embodiments, the office pod comprises said skin layer having a coincidence frequency outside of said predetermined human speech frequency region defined based on human speech frequency (or frequencies) which has the greatest intensity and/or carries the most information in spoken content.

For feasibility of technical implementation in the wall of an office pod, it is advantageous that the coincidence frequency is above the above-mentioned frequency (region).

In certain embodiments, considering the above, it has been observed that it is advantageous if the coincidence frequency is above 5 kHz, more preferably above 8 KHz.

Accordingly, in certain embodiments, said coincidence frequency is above 5 kHz, preferably above 8 KHz.

In this context, "coincidence frequency" refers to a frequency where there is a coincidence effect-controlled region in sound transmission loss in the skin layer. That is, beyond this "coincidence frequency", there is the coincidence effect-controlled region in sound transmission loss.

Furthermore, the notion of "the coincidence frequency of the skin layer is above [frequency]" is to be understood so that the above-mentioned coincidence effect-controlled region does not extend below that [frequency].

In certain embodiments, the skin layer is the only sound stopping layer in the wall structure.

In certain embodiments, the sound absorbing element has a total thickness greater than ⅛ of the wavelength of human speech at the frequency of 500 Hz (having emphasis in soundproofing regarding the greatest intensity of a typical or average human speech frequency (region)).

In certain embodiments, the sound absorbing element is superimposed on the skin layer.

In certain embodiments, the office pod comprises said skin layer forming an exterior surface of the office pod followed by the sound absorbing element facing an interior of the office pod. In certain embodiments, the skin layer is of sound stopping material, such as metal or sheet metal. In certain embodiments, the skin layer is of steel.

In certain embodiments, the sound absorbing element comprises a first sound absorbing material layer and second sound absorbing material layer of which the second sound absorbing material layer is closer to the interior of the office pod and forms an inner liner layer. In certain embodiments, the layers of the sound absorbing element are superimposed layers.

In certain embodiments, the inner liner layer is of more robust and/or dense material compared to the material of the first sound absorbing material layer.

In certain embodiments, the office pod comprises at least one air layer in between the skin layer and a sound absorbing material layer of (or belonging to) the sound absorbing element. In certain embodiments, an air layer is positioned (sandwiched) in between a sound absorbing material layer and the skin layer. In certain embodiments, the office pod comprises at least one air layer in between the skin layer and the inner liner layer.

In certain embodiments, the total thickness of the air layer(s) is less than half of the total thickness of the sound absorbing element. Accordingly, the total thickness of sound absorbing material layers within the sound absorbing element is at least half of the thickness of the sound absorbing element.

In certain embodiments, the functional layers as to soundproofing in a sidewall of the office pod consist of said skin layer and said sound absorbing element superimposed on the skin layer (optionally leaving an air gap or an air layer therebetween). This does not exclude any further thin layers (that are acoustically non-functional or inconsequential layers as to soundproofing) to be positioned within the wall structure. An example of such an acoustically non-functional or inconsequential layer is a thin foil such as a plastic foil which may be introduced in the wall structure as, for example, a humidity barrier but which is acoustically non-functional or inconsequential.

In certain embodiments, the office pod comprises said sound absorbing element with a high flow resistivity. In certain embodiments, the flow resistivity is high, however, within a desired range without causing reflections at human speech frequencies to the degree being audibly disturbing for a human conversationalist.

In certain embodiments, the second sound absorbing material layer has a flow resistivity greater than the flow resistivity of the first sound absorbing material layer.

In certain embodiments, the sound absorbing element has an overall flow resistivity below 100 kPas/$m^2$ (kilopascal seconds per square meter), more preferably below 40 kPas/$m^2$. The purpose is to avoid unwanted sound reflections, especially in consonants in human speech, from the sound absorbing element (or layer). In certain embodiments, the flow resistivity of each layer of the sound absorbing element is below the selected maximum (100 kPas/$m^2$ or 40 kPas/$m^2$). Such a maximum is especially applicable in case there is an inner liner layer facing the pod interior wherein the inner liner layer has a higher flow resistivity than the other material layer(s) of the sound absorbing element. Such an inner liner layer with a higher flow resistivity is advantageous in that it provides a durable inner surface for the pod interior, enabling a material with a lower flow resistivity to be used behind it.

In certain embodiments, the first sound absorbing material layer has an overall flow resistivity within the range extending from 4 to 30 kPas/$m^2$, more preferably within the range extending from 5 to 15 kPas/$m^2$.

In certain embodiments, the flow resistivity of the inner liner is at maximum of 100 kPas/$m^2$, more preferably at maximum of 40 kPas/$m^2$, and the flow resistivity of the other material layer(s) of the sound absorbing element is within the range extending from 4 kPas/$m^2$ to 30 kPas/$m^2$, more preferably from 5 kPas/$m^2$ to 15 kPas/$m^2$.

In certain embodiments, the flow resistivity of the inner liner is at maximum of 100 kPas/$m^2$, more preferably at maximum of 40 kPas/$m^2$, and the flow resistivity of a sound absorbing layer (such as said first sound absorbing material layer) behind the inner liner is within the range extending from 4 kPas/$m^2$ to 30 kPas/$m^2$, more preferably from 5 kPas/$m^2$ to 15 kPas/$m^2$.

In certain embodiments, the wall structure forms a sidewall of the pod connected to at least one support structure of the pod, such as a front frame and/or to a rear frame of the pod.

In certain embodiments, the sound absorbing element is of dustproof material(s) for avoidance of health hazards. Herein, dustproof material(s) refer to material(s) which do not release dust in quality and quantity hazardous to health when handled and/or when present near a user. For example, thermoplastic polyester fiber-based materials constitute dustproof sound absorbing materials whereas for example glass wool and rock wool are well known to release particles hazardous to health, especially when handled such as during constructing or assembling a wall structure containing such material(s).

In certain embodiments, the office pod comprises the skin layer attached to load-bearing support structures of the office pod so as to provide the support structures with cross-dimensional rigidity.

In certain embodiments, the skin layer is attached to pod support structures at its peripheral regions. In certain embodiments, the skin layer is attached to pod support structures at its peripheral regions only.

In certain embodiments, the load-bearing support structures are formed by a front load-bearing frame and a rear load-bearing frame.

In certain embodiments, the skin layer is in between the load-bearing frames (generally) in the form of a planar, uniform surface.

In certain embodiments, the skin layer in between the load-bearing frames is formed of two or more generally planar sub-pieces, especially 2, 3, or 4 sub-pieces, positioned adjacent to each other.

Each of the sub-pieces are generally in the form of a planar, uniform surface. However, in certain embodiments the office pod is provided with stiffening arrangement(s) at joining point(s) or region(s) at which adjacent sub-pieces are joined together. Accordingly, similarly as in a one-piece implementation in which the otherwise planar skin layer may be bent or curved at regions of the front and rear load-bearing frames (at which they are attached to said frame(s)), the sub-pieces are also generally planar except that they may be bent or curved at regions at which they are joined together with the frame(s) and/or adjacent sub-piece (s).

Accordingly, in certain embodiments, the office pod comprises a stiffening arrangement at a joining region at which one sub-piece is joined together with an adjacent sub-piece.

In certain embodiments, the stiffening arrangement is arranged by bending the sub-pieces against each other (and attaching an end portion of one sub-piece to an end portion of an adjacent sub-piece).

In certain embodiments, the sidewall of the pod is generally uniform in its structure. In certain embodiments, the sidewall is without openings, such as without a window, or without both a window and a door. In certain embodiments, the sidewall structure is a non-door containing structure.

In certain embodiments, the front and rear frames form structural parts of a front wall and a rear wall of the office pod. In certain embodiments, the front and rear walls lack a wall structure similar to the sidewall structure.

In certain embodiments, the office pod comprises a transparent front wall, such as a wall of glass. In certain embodiments, the front wall comprises a door.

According to a second example aspect there is provided a soundproofing wall structure formed of a sound absorbing element and a skin layer, wherein the skin layer has a coincidence frequency outside of a predetermined human speech frequency region.

According to a further example aspect of the present disclosure there is provided an office pod enclosing a soundproof workspace inside of the pod, comprising:

- a front load-bearing frame;
- a rear load-bearing frame; and
- a skin layer attached in between the front and rear load-bearing frames so as to provide the front and rear load-bearing frames with cross-dimensional rigidity.

A soundproof workspace in this context means that the office pod that encloses a soundproof workspace is purposely configured to prevent sound from propagating to the outside of the office pod, especially at the human speech frequency region. In preferable embodiments, the soundproofing is at a level at which spoken words inside the office pod can no longer be recognized on the outside of the pod, i.e. said soundproofing renders the speech inside the pod unintelligible on the outside of the pod.

Cross-dimensional in this context means dimensions that are not in the plane nor in parallel with the plane of the load-bearing frame(s) in question. Further, providing cross-dimensional rigidity (or support) is this context means providing (adequate) lateral bracing for the front and rear load-bearing frames. Accordingly, the skin layer providing cross-dimensional rigidity maintains the rectangular shape of the volume between the frames (i.e. provides the effect that the shape of the volume between the frames does not change).

In this context, a "load bearing" frame refers to a frame structure which provides point(s) of attachment and structural support for the other parts of the pod. That is, a "load bearing" frame is a part which takes structural force load from other above-floor parts of the pod and transfers it to the ground on which the pod stands.

In certain embodiments, the skin layer is in between the load-bearing frames substantially (generally) in the form of a planar, uniform (non-perforated) surface. The planarity and uniformity of the skin layer contribute to a desired acoustic behaviour. Here, the desired acoustic behaviour means a drumhead-like vibrating behaviour of the skin layer (as a metaphor). That is, in certain embodiments, the planarity of the skin layer, particularly outside its peripheral regions, enables advantageously minimizing its natural frequency, whereby any non-planar forms, especially angular ones such as corrugations, would detrimentally increase the natural frequency of the skin layer.

It is to be understood that any holes for means of fixing such as screws, bolts and the like are not to be construed as deviations from uniformity of (i.e. are not to be understood as perforations in) the skin layer, as such holes do not remain open for sound to freely pass through in the assembled pod comprising the skin layer.

In certain embodiments, the skin layer is (generally) in the form of a plane (i.e., without e.g. corrugations). This means in certain embodiments that elsewhere than in peripheral regions the skin layer is planar (in peripheral regions the skin layer may have non-planar shapes for stiffening and/or for attachment). In certain embodiments, of the total area of the skin layer, at least 80%, more preferably at least 90% is in the form of a plane (i.e. without corrugations or other angular forms), with the non-planar forms, if any, residing at the peripheral regions of the skin layer.

In certain embodiments, the skin layer in between the load-bearing frames is formed of two or more generally planar sub-pieces, especially 2, 3, or 4 sub-pieces, positioned adjacent to each other.

Each of the sub-pieces are generally in the form of a planar, uniform surface. The planarity and uniformity of the sub-pieces of the skin layer contribute to said desired acoustic behaviour. The above-mentioned planarity requirements apply also in such case(s).

In certain embodiments the office pod is provided with stiffening arrangement(s) at joining point(s) or region(s) at which adjacent sub-pieces are joined together. Accordingly, similarly as in a one-piece implementation in which the otherwise planar skin layer may be bent or curved at regions of the front and rear load-bearing frames (at which they are attached to said frame(s)), the sub-pieces are also generally planar except that they may be bent or curved at regions at which they are joined together with the frame(s) and/or adjacent sub-piece(s).

Accordingly, in certain embodiments, the office pod comprises a stiffening arrangement at a joining region at which one sub-piece is joined together with an adjacent sub-piece.

In certain embodiments, the stiffening arrangement is arranged by bending the sub-pieces against each other (and attaching an end portion of one sub-piece to an end portion of an adjacent sub-piece).

In certain embodiments, the office pod comprises the skin layer of sound stopping material forming an exterior surface (exterior cover) of the pod. In certain embodiments, the skin layer is of sheet metal. In certain embodiments, the skin layer is of sheet metal made of steel.

Sound stopping material, sometimes also known as soundproofing material, refers to material which predominantly blocks sound waves from travelling through that material, typically by reflection. Such materials are typically hard and dense. Examples of such materials are steel and concrete.

In certain embodiments, the office pod comprises a sidewall structure comprising said skin layer followed by a sound absorbing material layer. Accordingly, in certain embodiments, the sidewall structure is a layered structure. In certain embodiments, the sidewall structure comprises or consists of superimposed layers. In certain embodiments, the sound absorbing material layer is superimposed on the skin layer.

In certain embodiments, the sidewall structure is implemented without a further sound stopping layer. That is, in such cases, the skin layer is the only sound stopping layer in the sidewall (structure).

In certain embodiments, the sidewall structure comprises a sound absorbing element comprising a plurality of sound absorbing material layers. In certain embodiments, the sidewall structure comprises a sound absorbing element comprising an air layer. In certain embodiments, the sidewall structure comprises the sound absorbing element or a sound absorbing material layer spaced at a distance from the skin layer leaving an air layer therebetween. In certain embodiments, the sound absorbing element is formed of or comprises a sound absorbing material layer and an air layer.

In certain embodiments, the air layer is positioned (sandwiched) in between the sound absorbing material layer and the skin layer. In certain embodiments, the sound absorbing element comprises an inner liner layer facing the pod interior. In certain embodiments, the inner liner has a higher flow resistivity than the sound absorbing material layer. In certain embodiments, the inner liner layer forms a second sound absorbing material layer (whereas the first-mentioned sound absorbing material layer forms a first sound absorbing material layer). In certain embodiments, the order of different layers in the sidewall structure are as follows: skin layer (outermost layer), air layer, first sound absorbing material layer, and inner liner layer (innermost layer). In certain other embodiments, the order of different layers in the sidewall structure are as follows: skin layer (outermost layer), first sound absorbing material layer, air layer, and inner liner layer (innermost layer). In certain yet other embodiments, the air layer resides in the middle of the first sound absorbing material layer. In certain yet other embodiments, there are a plurality of air layers within the sidewall structure.

In certain embodiments, the layers of the of the sidewall structure are non-overlapping in a direction perpendicular to the layers (i.e. in the direction that is perpendicular to largest-area surfaces of all layers).

Sound absorbing material refers to material which predominantly allows sound waves to propagate through the material, but while doing so absorbs sound waves so that they do not create echo. Such materials are typically light and airy. Examples of such materials are open-cell foams and textile fabrics.

It is to be understood, as a person skilled in the art readily does, that all materials possess to a degree both sound stopping and sound absorbing properties, but that for example in the case of concrete or steel, the sound stopping property vastly predominates the sound absorbing property, whereby such materials are understood to be sound stopping materials. And correspondingly, in the case of, say, glass wool, open cell foam, fibrous felt and textile fabric, the sound absorbing property vastly predominates the sound stopping property, whereby such materials are understood to be sound absorbing materials.

In certain embodiments, a total mass of the sidewall structure is at most half, or preferably at most one third, of a total mass of any of a front wall comprising the front load-bearing frame and a rear wall comprising the rear load-bearing frame.

In certain embodiments, the total thickness of the sidewall structure is less than 200 mm, more preferably less than 100 mm.

In certain embodiments, the sidewall structure is a non-modular structure. "Non-modular" in this context means that the skin layer and the sound absorbing element form separate layers not forming an integrated whole.

In certain embodiments, the office pod comprises the skin layer being less stiff than any of the load-bearing frames.

In certain embodiments, the skin layer is directly attached to the front and rear load-bearing frames.

In certain embodiments, the skin layer is indirectly attached to the front and rear load-bearing frames.

In certain embodiments, the office pod comprises a connector (which may be a rigid connector) connecting the front load-bearing frame and the rear load-bearing frame, and the skin layer being attached to the connector. In certain embodiments, the connector is in the form of a bar or beam. In certain embodiments, the connector is hollow. In certain embodiments, the hollow connector is to house wirings and/or electrical components. In certain embodiments, the hollow connector provides a fire enclosure for mains voltage electric components of the pod thereby eliminating a need for a separate fire enclosure for mains voltage electric components. When serving as such a fire enclosure, the hollow connector is made of incombustible material such as of metal, preferably steel, or flame-retardant plastic, preferably 5VA plastic.

In certain embodiments, the connector is a non-vertical connector. In certain embodiments, the connector is a horizontal or substantially horizontal connector.

In certain embodiments, the office pod comprises said skin layer at both a left-hand side and a right-hand side of the pod, wherein a chassis with cross-dimensional support is formed of said skin layers and said load-bearing frames.

In certain embodiments, the functional layers concerned with soundproofing in a sidewall of the office pod consist of said skin layer, and said sound absorbing element, said sound absorbing element consisting of said sound absorbing material layer with or without one or more air layers, and an optional inner liner (or interior panel) comprising sound absorbing material (superimposed on said sound absorbing material layer).

In certain elements, the rigidity of the pod is enhanced by a ceiling structure attached to the front load-bearing frame and to the rear load-bearing frame. In certain embodiments, the ceiling structure is preferably configured to implement a ventilation function.

In certain embodiments, the rigidity of the pod is further enhanced by a floor structure attached to the front load-bearing frame and to the rear load-bearing frame. In certain embodiments, said rigid connector is integrated into the floor structure.

In certain embodiments, the front load-bearing frame and/or the rear load-bearing frame comprises a door.

In certain embodiments, the front load-bearing frame and/or the rear load-bearing frame surrounds or at least partly surrounds a door or a door frame.

In certain embodiments, the front load-bearing frame constitutes an outermost encircling element of the front wall. In certain embodiments, the rear load-bearing frame constitutes an outermost encircling element of the rear wall.

According to a further example aspect of the present disclosure there is provided a method of assembling the office pod of the first aspect or any of its embodiments, comprising:

assembling a chassis of the office pod by first providing the front and rear load-bearing frames, followed by attaching right-hand side and left-hand side skin layers directly or indirectly to the front and rear load-bearing frames to form a cross-dimensionally rigid chassis, and thereafter attaching further parts of the office pod to said chassis for forming a finished office pod.

Different non-binding example aspects and embodiments have been illustrated in the foregoing. The embodiments in the foregoing are used merely to explain selected aspects or steps that may be utilized in different implementations. Some embodiments and features may be presented only with reference to certain example aspects. It should be appreciated that corresponding embodiments and features apply to other example aspects as well. Any appropriate combinations of the embodiments may be formed. Any apparatus and/or methods in the description and/or figures not covered by the claims are examples useful for understanding the present disclosure.

BRIEF DESCRIPTION OF THE FIGURES

Some example embodiments will be described with reference to the accompanying figures, in which.

DETAILED DESCRIPTION

Figure 1A:
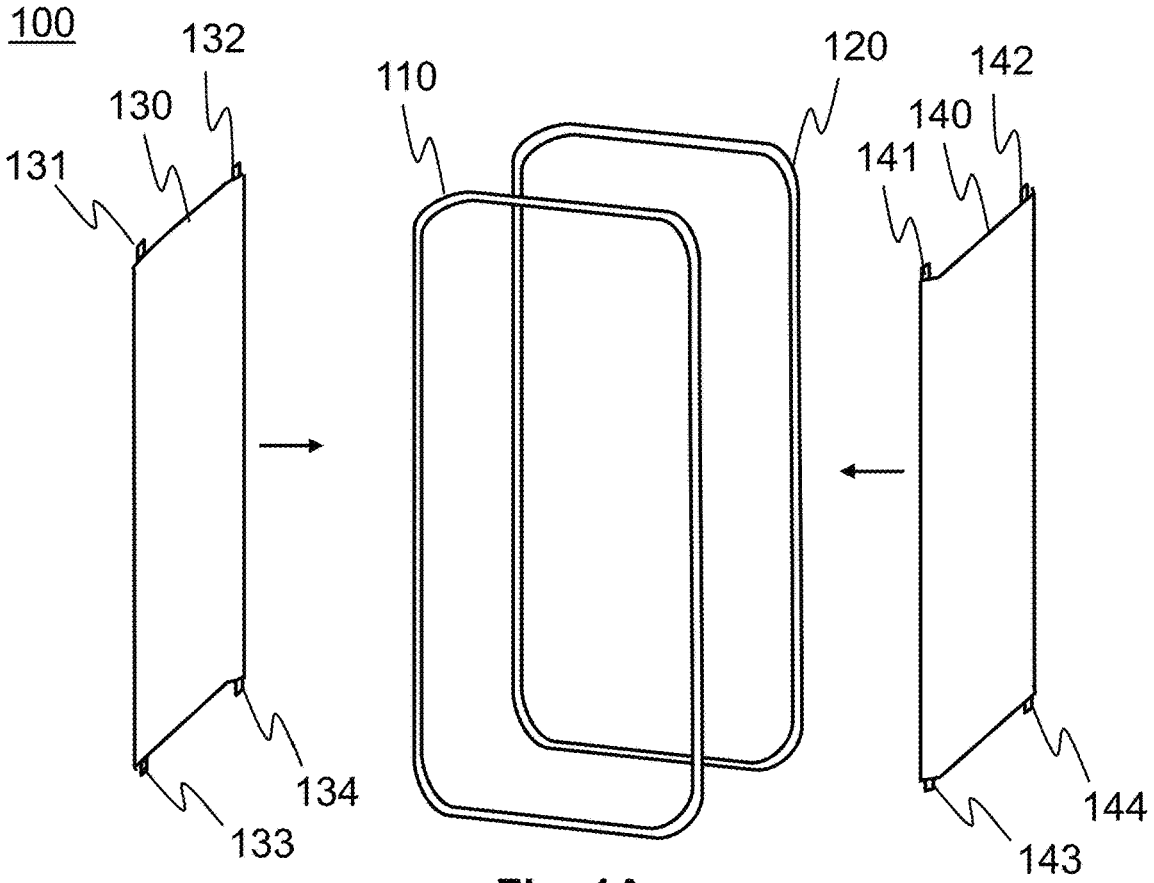
FIG. 1A shows an exploded view of parts of an office pod in accordance with certain embodiments.

In the following description, like reference signs denote like elements or steps. Reference is made to the FIGS. 1-21 with the following numerals and denotations:

100, 200, 300, 1300 Office pod
110, 210, 1210 Front load-bearing frame
120, 220, 1220 Rear load-bearing frame
130, 230 Left-hand side skin layer
131-134, 231-234 Attachment point
140, 240 Right-hand side skin layer
141-144, 241-244, 24X Attachment point
214, 224 Attachment element
215, 225 Magnet
230*a*, 230*b*, 1230*a*, 1230*b* Sub-pieces of left-hand side skin layer
240*a*, 240*b*, 1240*a*, 1240*b* Sub-pieces of right-hand side skin layer
240*c*, 1240*c* Stiffening arrangement
245, 245' Sound absorbing layer
245*a* Sound absorbing material layer
245*b* Air layer
246 Interior panel, inner liner layer
251, 1251 First connector
252 Second connector
255 Sound absorbing element
261, 1261 Third connector
262 Fourth connector
270, 370, 1370 Ceiling structure
271, 1271 Integrated ventilation system
280, 380, 1380 Floor structure
351, 361 Connectors integrated with ceiling structure
352, 362, 1352, 1362 Connectors integrated with floor structure
1231, 1232 Attachment point
1235 Add-on rail
1393 First corner piece
1394 Second corner piece
1555 Cross brace
1666 Hollow bar
$d_1$ Thickness of skin layer
$d_2$ Thickness of sound absorbing element
$d_a$ Thickness of sound absorbing material layer
$d_b$ Thickness of air layer Embodiments of an office pod in accordance with the present disclosure disclose an office pod enclosing a soundproof workspace inside of the pod, comprising a specific wall structure formed of a sound absorbing element and a skin layer. Further embodiments of an office pod in accordance with the present disclosure comprise a front load-bearing frame, a rear load-bearing frame, and a skin layer attached in between the front and rear load-bearing frames, wherein the skin layer provides the front and rear load-bearing frames with cross-dimensional rigidity. Accordingly, e.g., in certain embodiments, the office pod comprises said skin layer at both a left-hand side and a right-hand side of the pod, wherein a chassis of the pod with cross-dimensional rigidity (or support) is formed of said skin layers and said load-bearing frames. In certain embodiments, cross-dimensional rigidity of said frames means a structural property of resisting the frames becoming and/or being tilted from an upright position. In other words, cross-dimensional rigidity of said frames means resistance against forces trying to alter the mutual position of said frames once erected, especially in a tilting manner. However, it should be noted that for every embodiment of the present disclosure it is not necessary for the skin layer to provide any load-bearing frames said cross-dimensional rigidity, but the soundproofing wall structure presented in the present disclosure can alternatively be applied to office pods of a conventional type. In such embodiments, the soundproofing wall structure presented in the present disclosure can be applied in between desired support structures in order to assemble soundproofing walls for an office pod.

Figure 1B:
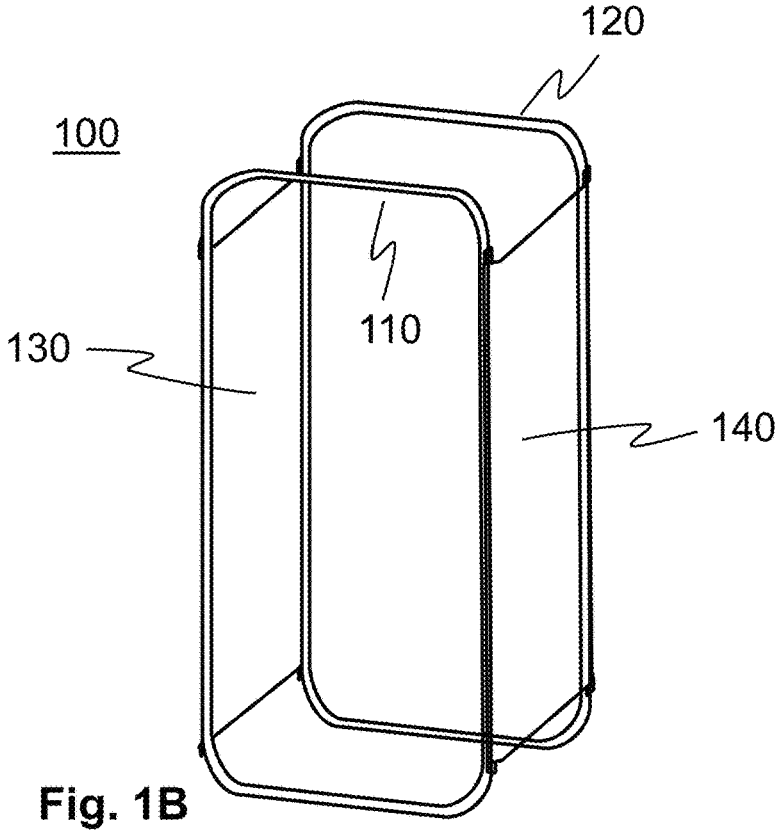
FIG. 1B shows an assembly of the office pod with the parts shown in FIG. 1A.

FIG. 1A shows an exploded view of selected parts of an office pod 100 in accordance with certain embodiments, and FIG. 1B shows an assembly of a chassis of the office pod 100 with the parts shown in FIG. 1A. The office pod 100 comprises a front load-bearing frame 110, a rear load-bearing frame 120, a left-hand side skin layer 130, and a right-hand side skin layer 140. The left-hand side skin layer 130 is attached in between the front load-bearing frame 110 and the rear load-bearing frame 120 at the left-hand side of the pod 100, and the right-hand side skin layer 140 is attached in between the front load-bearing frame 110 and the rear load-bearing frame 120 at the right-hand side of the pod 100.

Said attaching "in between" the load-bearing frames in this context and further in the following description means that the skin layers reside in between the load-bearing frames but need not reside in between the load-bearing frames in their absolute entirety. For example, edge portions of the skin layer in certain embodiments are overlapping with respect to the respective load-bearing frames e.g. for an attachment purpose. Thus, a skin layer attached in between the front and rear load-bearing frames is to understood so that the skin layer may, at its peripheral regions, gain attachment from the load-bearing frames in such a manner that the skin layer may, at said peripheral regions, overlap with the frames but is otherwise between the load-bearing frames.

The skin layer(s) 130, 140 provide the front and rear load-bearing frames 110, 120 with cross-dimensional rigidity (lateral bracing).

The left-hand side skin layer 130 comprises an attachment point 131-134 at each corner (or corner region) of the layer 130. Similarly, the right-hand side skin layer 140 comprises an attachment point 141-144 at each corner (or corner region) of the layer 140. The skin layers 130, 140 are attached to the front and rear load-bearing frames 110, 120 at the attachment points 131-134 and 141-144 (preferably in an immovable manner) so as to provide the front and rear load-bearing frames 110, 120 with cross-dimensional rigidity. Further, in certain embodiments, the skin layers 130, 140 in between the frames 110, 120 generally are in the form of a planar, uniform surface (forming a sound stopping layer).

Figure 2A:
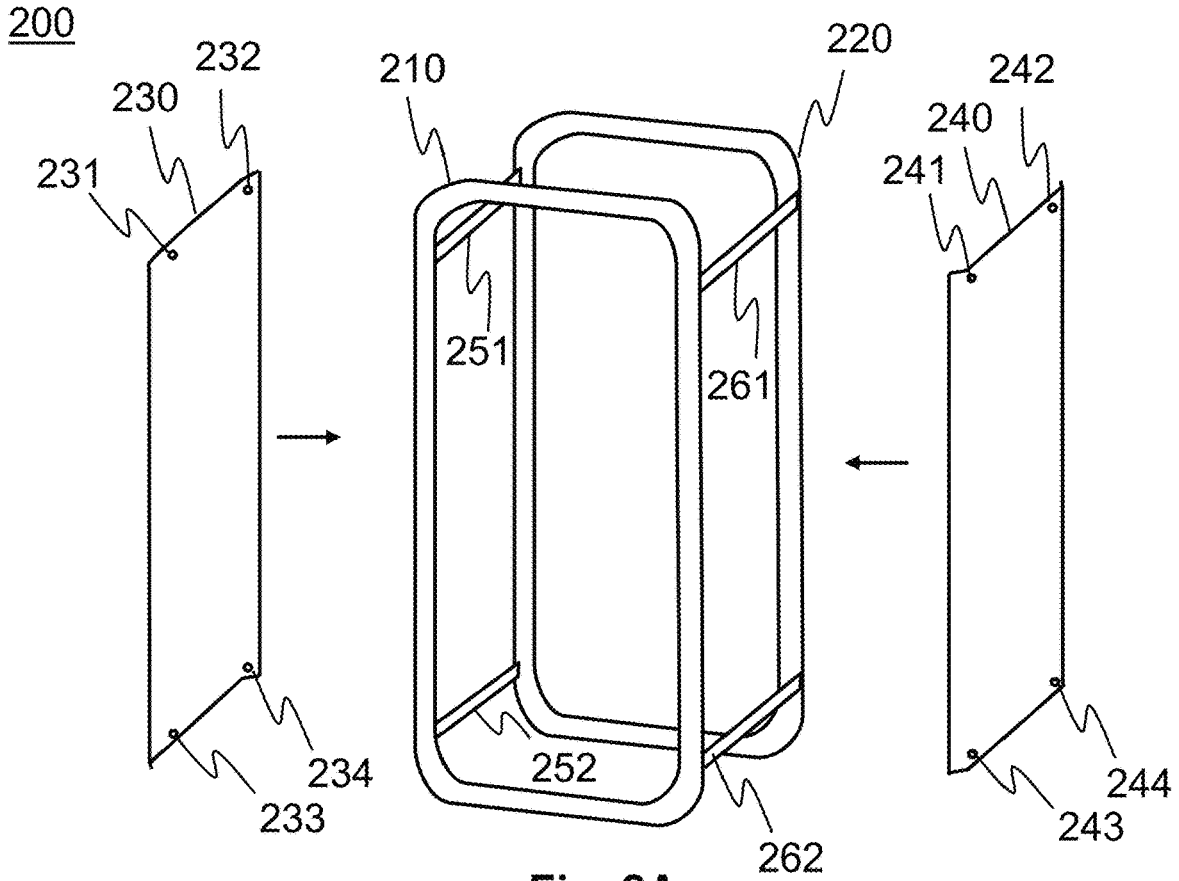
FIG. 2A shows an exploded view of parts of an office pod in accordance with certain other embodiments.
Figure 2B:
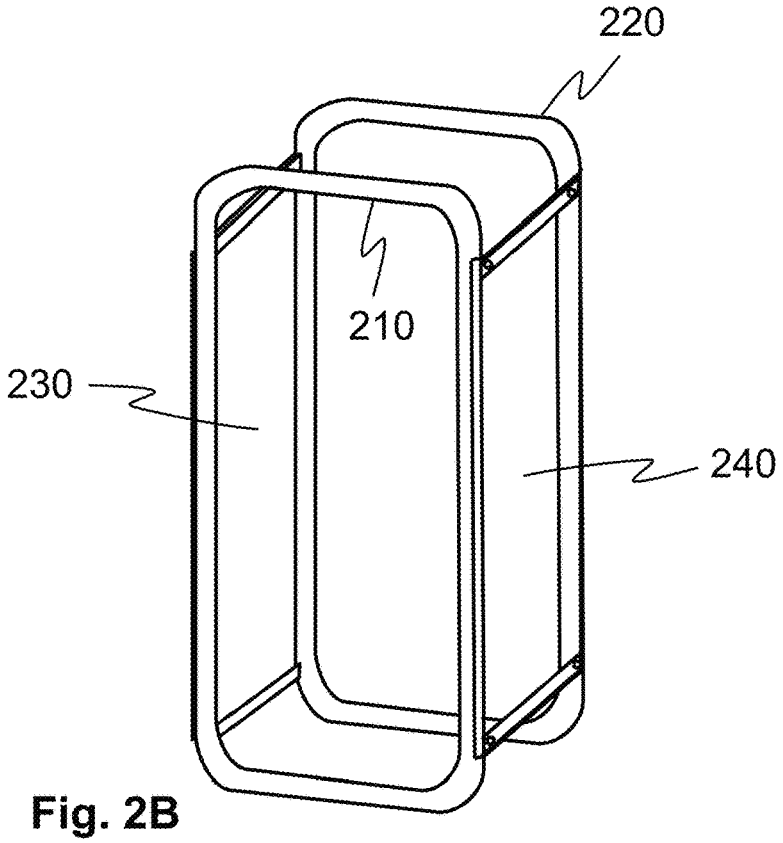
FIG. 2B shows an assembly of the office pod with the parts shown in FIG. 2A.

FIG. 2A shows an exploded view of selected parts of an office pod 200 in accordance with certain embodiments, and FIG. 2B shows an assembly of a chassis of the office pod 200 with the parts shown in FIG. 2A. The office pod 200 comprises a front load-bearing frame 210, a rear load-bearing frame 220, a left-hand side skin layer 230, and a right-hand side skin layer 240. The left-hand side skin layer 230 is attached in between the front load-bearing frame 210 and the rear load-bearing frame 220 at the left-hand side of the pod 200, and the right-hand side skin layer 240 is attached in between the front load-bearing frame 210 and the rear load-bearing frame 220 at the right-hand side of the pod 200. The skin layer(s) 230, 240 provide the front and rear load-bearing frames 210, 220 with cross-dimensional rigidity (lateral bracing). Further, in certain embodiments, the skin layers 230, 240 in between the frames 210, 220 generally are in the form of a planar, uniform surface (forming a sound stopping layer).

The left-hand side skin layer 230 comprises an attachment point 231-234 at each corner (or corner region) of the layer 230. Similarly, the right-hand side skin layer 240 comprises an attachment point 241-244 at each corner (or corner region) of the layer 240. In contrast to the embodiments shown in FIGS. 1A and 1B, the skin layers 230, 240 are not directly attached to the frames 210, 220, but there are separate connectors 251, 252, 261, 262 connecting the frames 210, 220, and the skin layers 230, 240 are attached to the frames 210, 220 (preferably in an immovable manner) via respective connectors.

In the embodiments shown in FIGS. 2A and 2B, the left-hand side skin layer 230 is attached at its top corners (or corner regions) at attachment points 231 and 232 to a first (upper) connector 251 attached in between the frames 210, 220 at the upper left-hand side of the pod 200. Similarly, the left-hand side skin layer 230 is attached at its lower corners (or corner regions) at attachment points 233 and 234 to a second (lower) connector 252 attached in between the frames 210, 220 at the lower left-hand side of the pod 200.

The right-hand side skin layer 240 is attached at its top corners (or corner regions) at attachment points 241 and 242 to a third (upper) connector 261 attached in between the frames 210, 220 at the upper right-hand side of the pod 200. And, similarly, the right-hand side skin layer 240 is attached at its lower corners (or corner regions) at attachment points 243 and 244 to a fourth (lower) connector 262 attached in between the frames 210, 220 at the lower right-hand side of the pod 200.

The connectors 251, 252, 261, 262 themselves in certain embodiments are as such substantially non-participating as to functionally providing the front and rear load-bearing frames 210, 220 with cross-dimensional rigidity, but the skin layers 230 and 240 provide the front and rear load-bearing frames 210, 220 with cross-dimensional rigidity (as a combined effect together with the connectors 251, 252, 261, 262 in certain embodiments).

Put more generally, the connectors 251, 252, 261 262 need not provide the front and rear load-bearing frames 210, 220 with cross-dimensional rigidity due to skin layers 230, 240 providing this functionality, though the connectors 251, 252, 261, 262 doing so is not detrimental to the rigidity of the pod chassis. Consequentially, the connectors 251, 252, 261, 262 may be attached to the front and rear load-bearing frames 210, 220 in a simple and economical manner.

Further, the embodiments shown in FIG. 1A-2B present attachment points at corners or corner regions. It should be noted that the present disclosure shall not be limited to solutions having attachment points only at corners (or corner regions) but in embodiments of the present disclosure there are or may be attachment points also in other regions of the respective skin layers (as shown for example in connection with FIGS. 10A, 10B, 11A, and 11B in the following description). However, any attachments point in these and further embodiments are preferably located at peripheral regions of the skin layer(s). In certain embodiments, the skin layer(s) are attached at their peripheral regions and the remaining (i.e., centre) region is non-attached. In certain embodiments, the skin layer(s) do not touch any structure behind them so that they are able to freely vibrate.

Figure 3A:
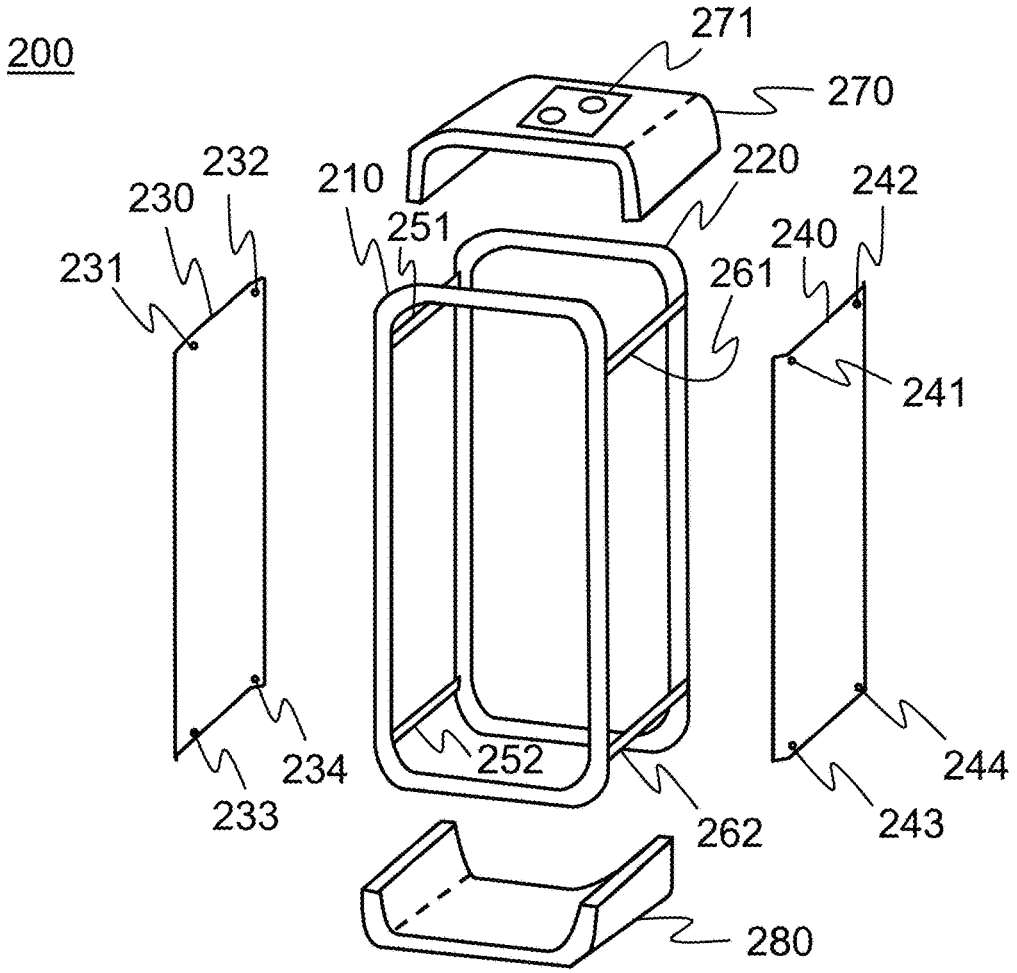
FIG. 3A shows another exploded view of parts of an office pod in accordance with certain embodiments.
Figure 3B:
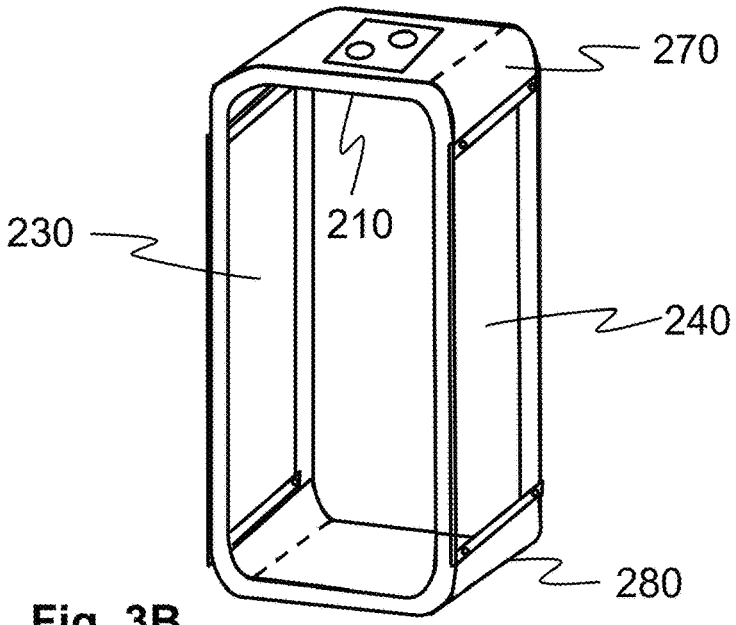
FIG. 3B shows an assembly of the office pod with the parts shown in FIG. 3A.

FIG. 3A shows an exploded view of selected parts of the office pod 200 in accordance with certain embodiments, and FIG. 3B shows an assembly of a chassis plus a ceiling and a floor of the office pod 200 with the parts shown in FIG. 3A. The embodiments shown in FIGS. 3A and 3B otherwise completely correspond to the structure and operation of the pod 200 shown and described in the preceding in connection with FIGS. 2A and 2B, but FIGS. 3A and 3B further show a ceiling structure 270 and a floor structure 280 attached to the front load-bearing frame 210 and to the rear load-bearing frame 220. In certain embodiments, the ceiling structure 270 and the floor structure 280 as such are substantially non-participating as to functionally providing the front and rear load-bearing frames 210, 220 with cross-dimensional rigidity. However, in certain embodiments, the rigidity of the pod 200 is further enhanced by attaching the ceiling structure 270 and the floor structure 280.

Put more generally, the ceiling structure 270 and the floor structure 280 need not provide the front and rear load-bearing frames 210, 220 with cross-dimensional rigidity due to skin layers 230, 240 providing this functionality, though the ceiling structure 270 and the floor structure 280 doing so is not detrimental to the rigidity of the pod chassis. Consequentially, the ceiling structure 270 and the floor structure 280 may be attached to the front and rear load-bearing frames 210, 220 in a simple and economical manner.

In certain embodiments, the ceiling structure 270 is configured to implement a ventilation function. For this purpose, in certain embodiments, the ceiling structure comprises an integrated ventilation system 271.

Figure 4A:
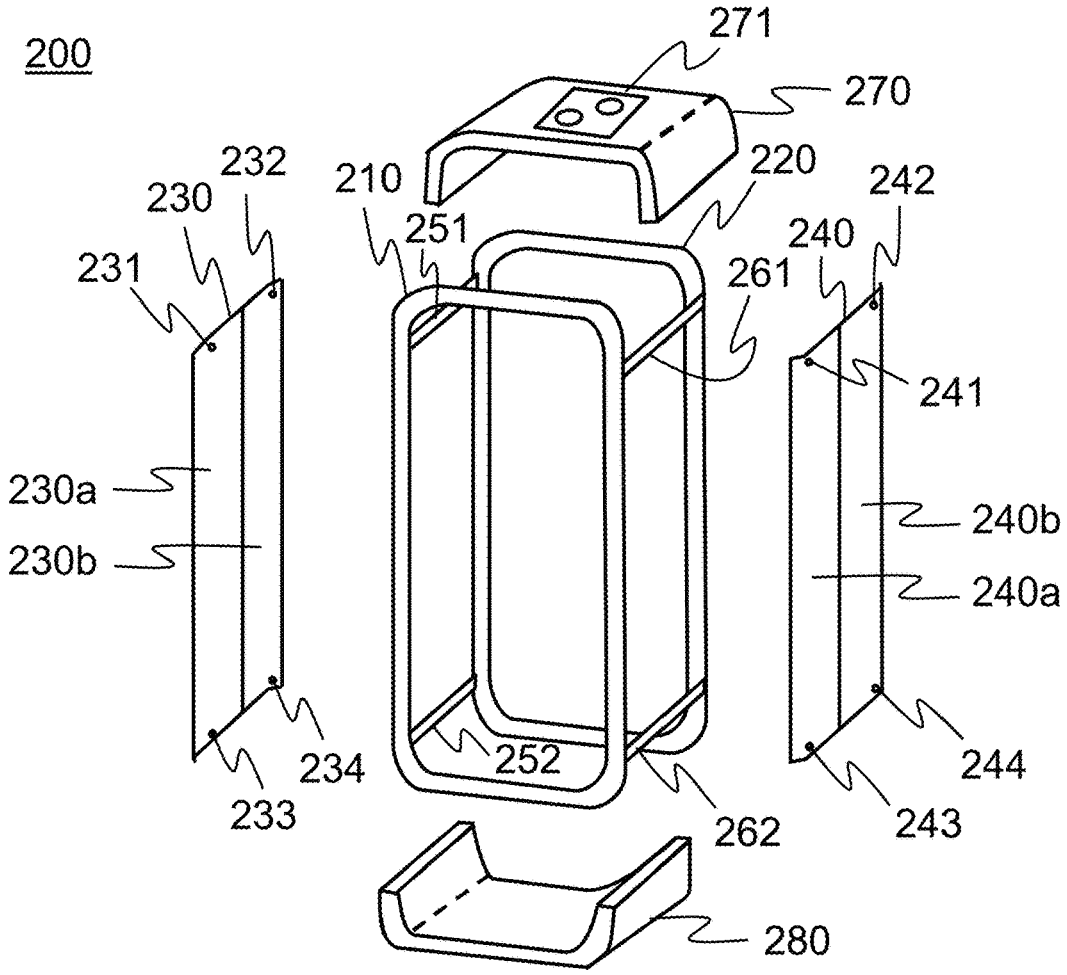
FIG. 4A shows yet another exploded view of parts of an office pod in accordance with certain embodiments.
Figure 4B:
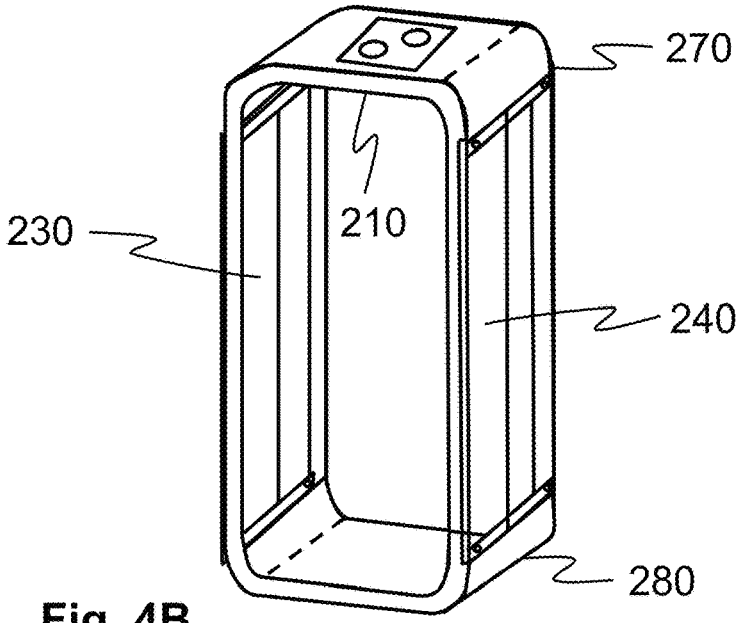
FIG. 4B shows an assembly of the office pod with the parts shown in FIG. 4A.

FIG. 4A shows an exploded view of selected parts of the office pod 200 in accordance with certain embodiments, and FIG. 4B shows an assembly of a chassis plus a ceiling and a floor of the office pod 200 with the parts shown in FIG. 4A. The embodiments shown in FIGS. 4A and 4B otherwise completely correspond to the structure and operation of the pod 200 shown and described in the preceding in connection with FIGS. 2A, 2B, 3A and 3B, but FIGS. 4A and 4B further show the left-hand side skin layer 230 formed of two sub-pieces 230*a* and 230*b*. Similarly, the right-hand side skin layer 240 is formed of two sub-pieces 240*a* and 240*b*. In certain embodiments, joining points or regions of the sub-pieces contain appropriate stiffening arrangements (so as to provide stiffness to withstand a skin layer-bulging force caused for example a person in the pod leaning against the wall). In certain embodiments, the joining regions reside at edge regions of the sub pieces, while other areas (central areas) of the sub-pieces generally are in the form of a planar, uniform surface (forming a sound stopping layer). The joining points or regions in certain embodiments contain or provide attachment loci for fixings with which the sub-pieces 240*a*, 240*b* are attached together.

Figure 5A:
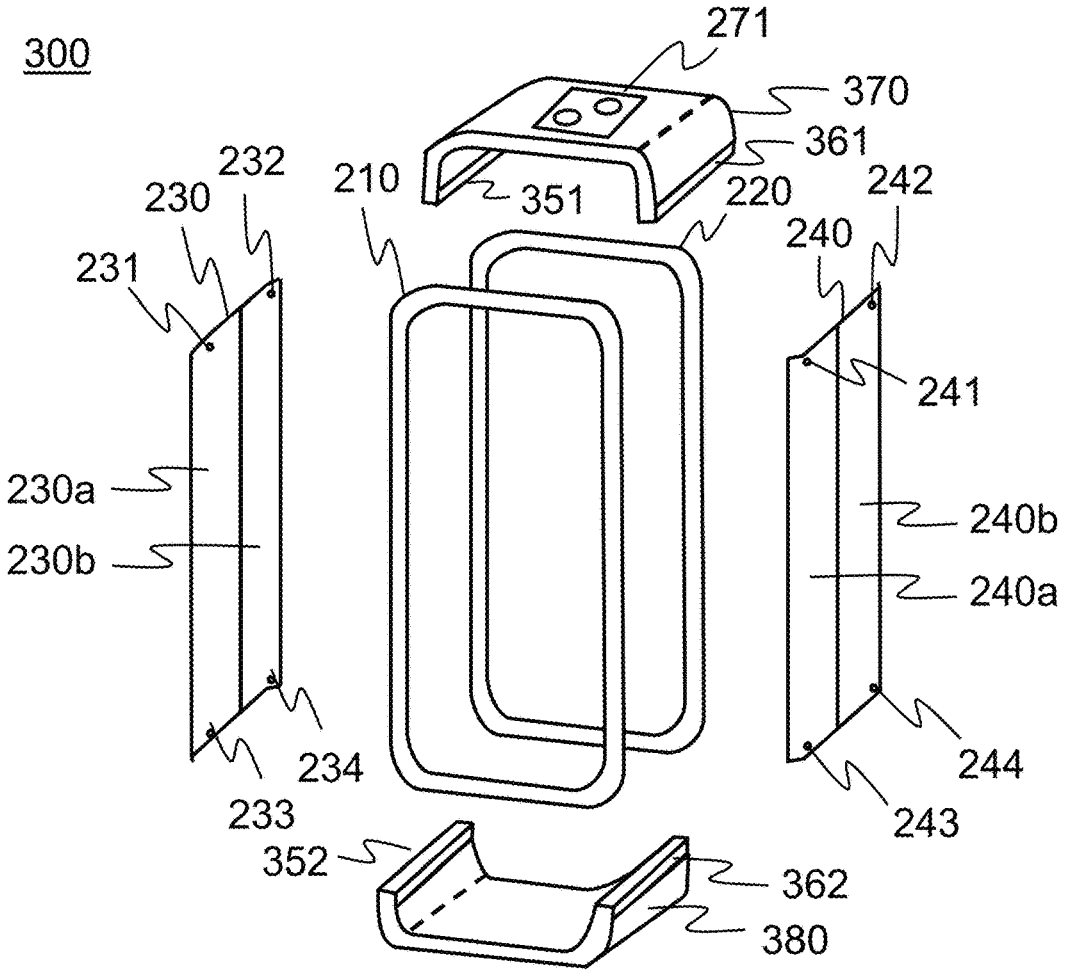
FIG. 5A shows yet another exploded view of parts of an office pod in accordance with certain embodiments.
Figure 5B:
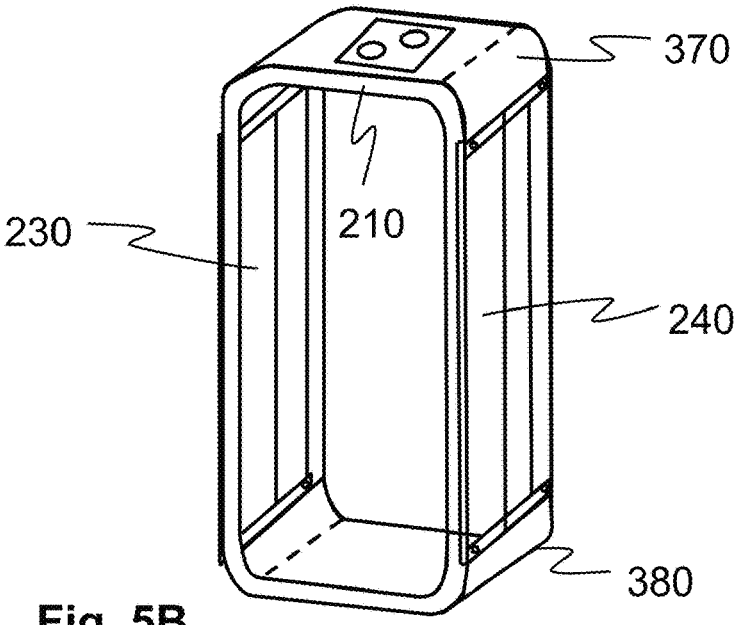
FIG. 5B shows an assembly of the office pod with the parts shown in FIG. 5A.

FIG. 5A shows an exploded view of selected parts of an office pod 300 in accordance with certain embodiments, and FIG. 5B shows an assembly of a chassis plus a ceiling and a floor of the office pod 300 with the parts shown in FIG. 5A. The embodiments shown in FIGS. 5A and 5B otherwise completely correspond to the structure and operation of the pod 200 shown and described in the preceding in connection with FIGS. 2A to 4B, but FIGS. 5A and 5B further show the upper connectors (marked by 351 and 361) integrated with the ceiling structure (marked by 370), and the lower connectors (marked by 352 and 362) integrated with the floor structure (marked with 380).

Figures 6A, 6B, 6C:
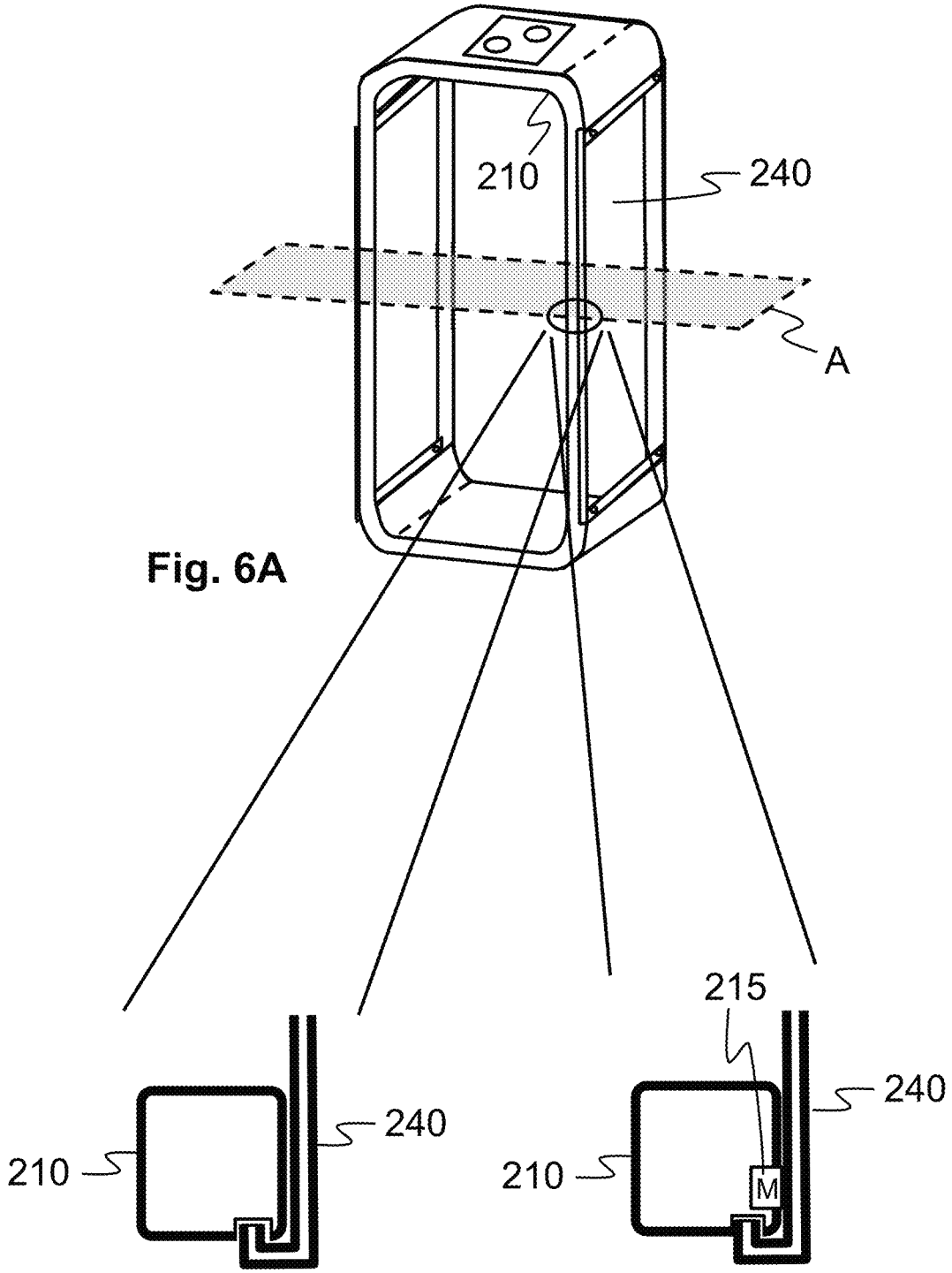
FIG. 6A shows an office pod cut by a virtual horizontal plane to obtain cross-sectional views in accordance with certain embodiments.
FIG. 6B shows a first cross-sectional view.
FIG. 6C shown an alternative cross-sectional view.

FIG. 6A shows the office pod 200 cut by a virtual horizontal plane A to obtain cross-sectional views of the office pod 200 at a location at which the right-hand side skin layer 240 connects with the front load-bearing frame 210. FIG. 6B shows an example in which a curved end portion of the skin layer 240 fits into a respective vertical groove in the frame 210. FIG. 6C shows an example which otherwise corresponds to the example shown in FIG. 6A except that the frame 210 further comprises a magnet or magnets 215 at a side of the frame 210 to provide an attractive magnetic force between the frame 210 and the skin layer 240. Such magnet (s) 215 provide ease of assembly as the skin layer 240 can be magnetically snapped in place, whereafter any other fixing(s) can be performed with the skin layer 240 already remaining in place. Such magnet(s) 215 provide attaching force between the frame(s) 210 and the skin layer 240 so as to prevent rattling of the skin layer 240 against the frame(s) 210 without a need to use in those areas fixings which are more time-consuming in pod assembly and/or require penetration through the acoustically consequential skin layer 240. The same applies to the use of magnet(s) as described below.

Figure 7A:
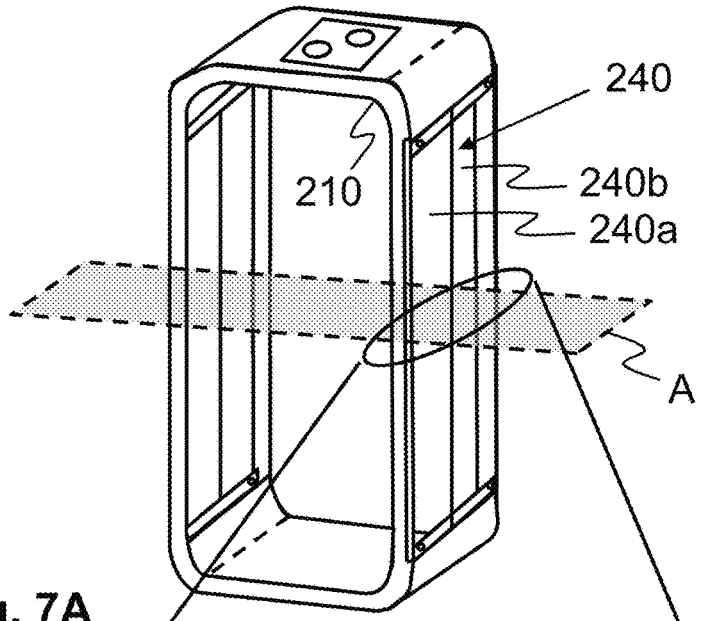
FIG. 7A shows another office pod cut by a virtual horizontal plane to obtain a cross-sectional view.

FIG. 7A shows the office pod 200 cut by a virtual horizontal plane A to obtain a cross-sectional view of a right-hand side wall structure of the office pod 200. In this example, as shown in the cross-section of FIG. 7B, the right-hand side skin layer 240 is formed of two sub-pieces 240*a* and 240*b*, and the joining region where the sub-pieces 240*a*, 240*b* join includes a stiffening arrangement 240*c*. The sub-pieces 240*a*, 240*b* comprise respective curved end portions to fit into respective vertical grooves in the respective frames 210, 220. The frames 210, 220 may contain magnets 215, 225 at respective sides of the frames 210, 220 to provide an attractive magnetic force between the frames 210, 220 and the respective sub-pieces 240*a*, 240*b*. The sub-pieces 240*a*, 240*b* may conformally continue along the surfaces of the respective frames beyond the location of the grooves as shown by dotted lines in FIG. 7B.

The skin layer 240 formed of the sub-pieces 240*a*, 240*b* is followed by a sound absorbing layer 245 when moving towards an interior of the office pod 200. The sound absorbing layer may be attached to the front and rear load-bearing frames 210, 220 by respective attachment elements 214, 224.

Figure 7B:
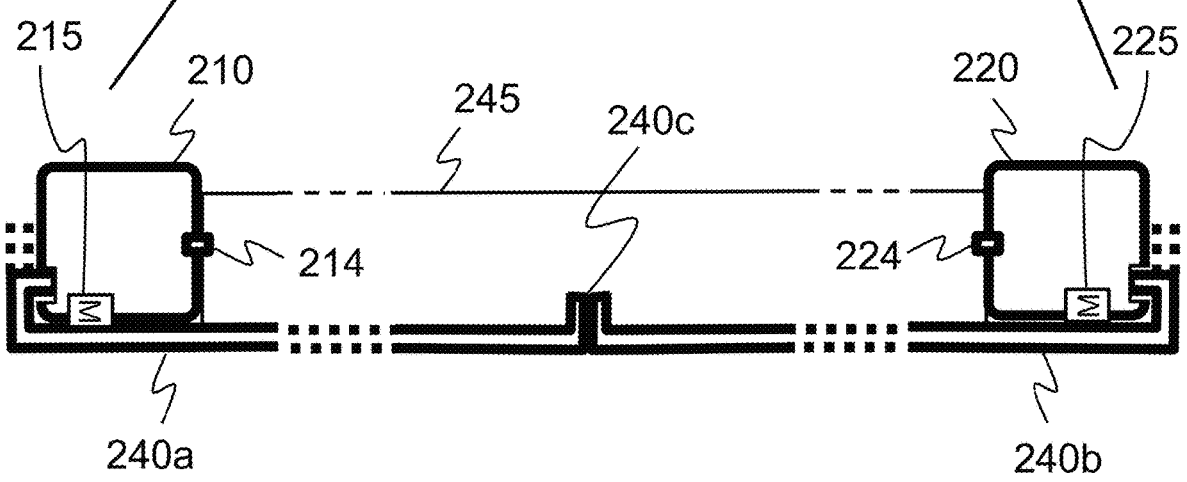
FIG. 7B shows the cross-sectional view of the office pod of FIG. 7A.

The central regions of the sub-pieces 240*a* and 240*b* (and respective regions of the sound absorbing layer 245) have not been drawn in FIG. 7B, but they have been marked by dashed lines.

Figure 8A:
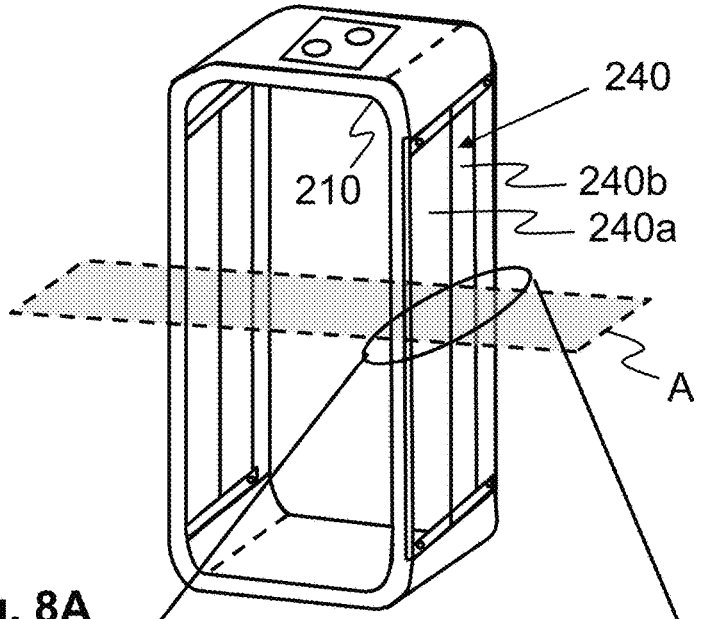
FIG. 8A shows another embodiment with an office pod cut by a virtual horizontal plane to obtain a cross-sectional view.
Figure 8B:
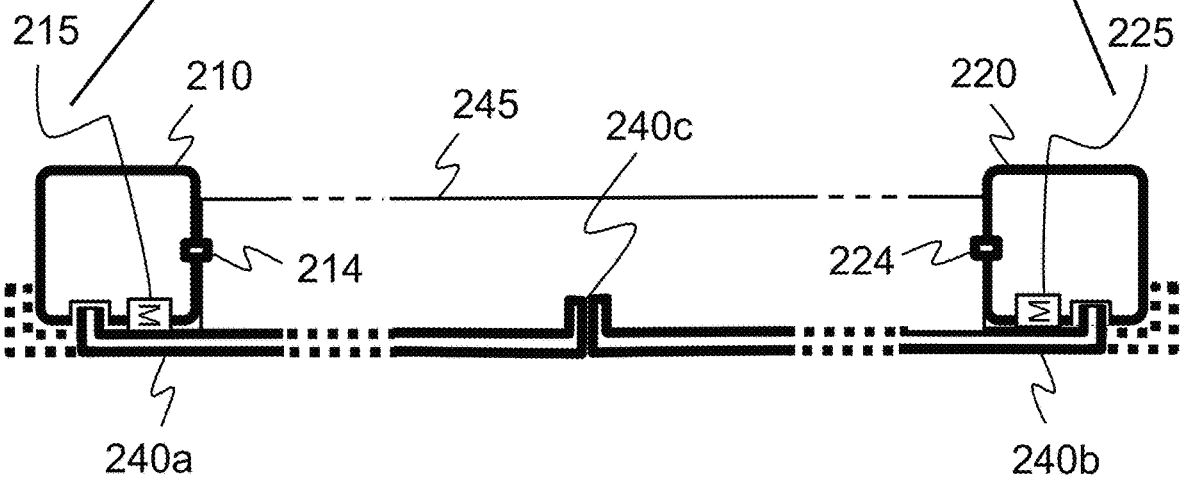
FIG. 8B shows the cross-sectional view of the office pod of FIG. 8A.

FIG. 8A shows the office pod 200 cut by a virtual horizontal plane A similarly as in FIGS. 7A and 7B. FIG. 8B shows another example of the cross-section of the right-hand side wall structure in the event the right-hand side skin layer 240 is formed of the two sub-pieces 240*a* and 240*b*. The embodiments shown in FIGS. 8A and 8B otherwise completely correspond to the structure and operation of the pod 200 shown and described in the preceding in connection with FIGS. 7A and 7B, but the connection point or region at which the sub-pieces 240*a*, 240*b* connect with the respective frames 210, 220 is at a different location. Accordingly, the groove in the frames 210, 220 into which the end portions (or protrusive portions) of the sub-pieces 240*a*, 240*b* is fitted is positioned at a face of the respective frame 210, 220 that is substantially parallel to the face of the respective sub-piece 240*a*, 240*b*. The sub-pieces 240*a*, 240*b* may conformally continue along the surfaces of the respective frames beyond the location of the grooves (also over a corner of a respective frame) as shown by dotted lines in FIG. 8B.

The central regions of the sub-pieces 240*a* and 240*b* (and respective regions of the sound absorbing layer 245) have not been drawn in FIG. 8B, but they have been marked by dashed lines.

Figure 9A:
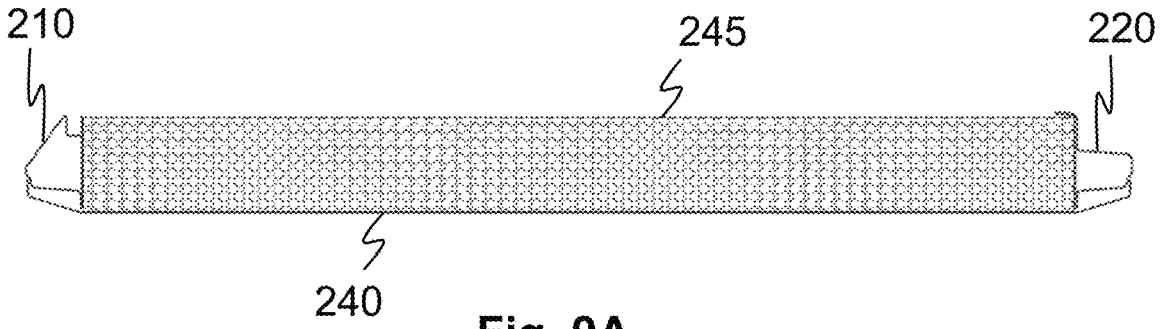
FIGS. 9A-9C show cross-sectional views of a sidewall structure of an office pod in accordance with the certain embodiments.

FIG. 9A shows a cross-sectional view of the right-hand side wall structure (with the following being equally applicable to a left-hand side wall structure) of the office pod 200 in accordance with the certain embodiments. The wall structure substantially consists of the skin layer 240 followed by (superimposed on) the sound absorbing layer 245. The skin layer 240 is substantially in the form of a plane in its region that resides between the front load-bearing frame 210 and the rear load-bearing frame 220. At the region of the frames 210, 220, the skin layer 240 in certain embodiments comprises in these peripheral regions a bend or a curved portion for attachment and/or for providing edge region(s) of the skin layer 240 with structural rigidity. In other embodiments, the skin layer 240 remains planar also at the region of the frames.

Figure 9B:
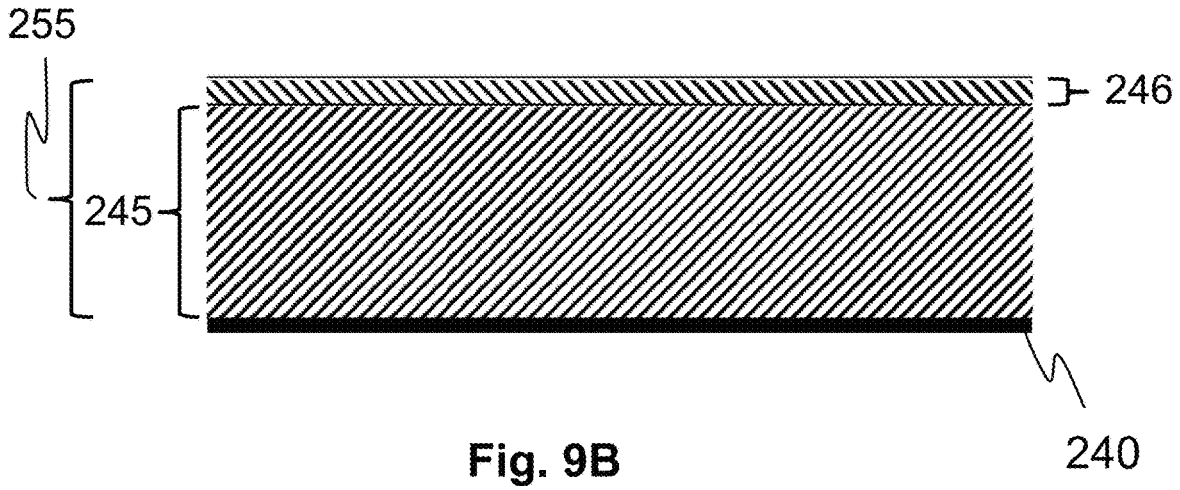

FIG. 9B shows a partial cross-sectional view of the right-hand side wall structure (with the following being equally applicable to a left-hand side wall structure) of the office pod 200 in accordance with the certain further embodiments. In addition to the skin layer 240 and the (first) sound absorbing layer 245, the wall structure further comprises a second sound absorbing layer 246 (such as an inner liner layer) on top of (superimposed on) the first sound absorbing layer 245, wherein the second sound absorbing layer 246 forms an interior surface of the office pod 200. In certain embodiments, the first and second sound absorbing layers 245 and 246 together form a sound absorbing element 255.

Figure 9C:
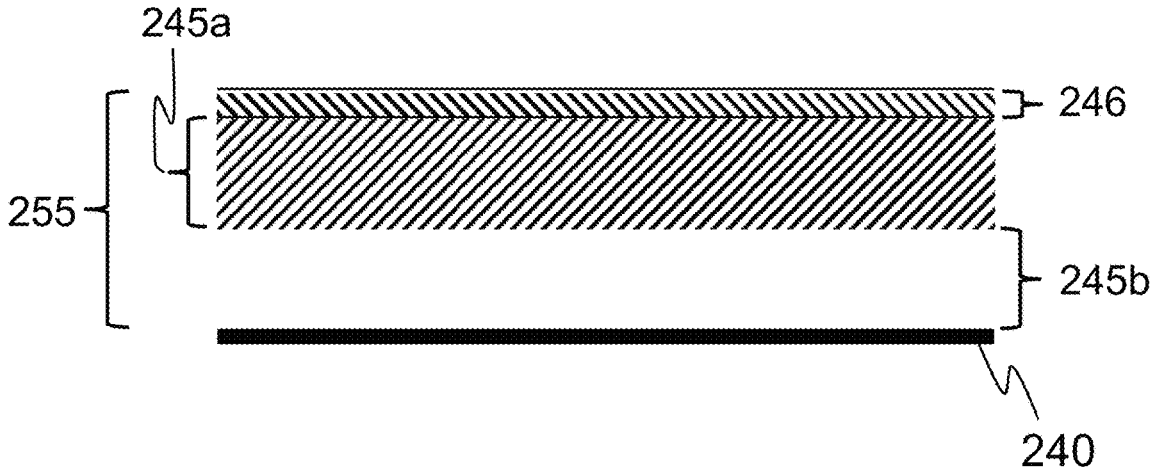

FIG. 9C shows a partial cross-sectional view of the right-hand side wall structure (with the following being equally applicable to a left-hand side wall structure) of the office pod 200 in accordance with the certain further embodiments. In those embodiments, the sound absorbing element 255 comprises a sound absorbing material layer 245*a* and an air (gap) layer 245*b* in addition to the inner liner layer 246. In other embodiments, the order of the sound absorbing material layer 245*a* and the air layer 245*b* is opposite to the one presented in FIG. 9C. Accordingly, the sound absorbing material layer 245*a* in certain embodiments is closer to the skin layer 240.

Generally, the wall structure comprises the skin layer 240 followed by the sound absorbing element 255. The sound absorbing element 255 comprises at least one sound absorbing layer 245 (or sound absorbing material layer 245*a*). In addition, the sound absorbing element 255 optionally comprises the inner liner layer 246 as the innermost layer. Instead or in addition, the sound absorbing element 255 optionally comprises one or more air (gap) layers 245*b* which may reside anywhere in between the skin layer 240 and the innermost material layer facing the pod user. In certain embodiments, the sound absorbing (material) layer is of fluffy material (such as Ewona fiber mat) compared to a more robust or dense material of the optional inner line layer 246. In certain embodiments, the sound absorbing element 255 is of dustproof material(s).

Figure 10A:
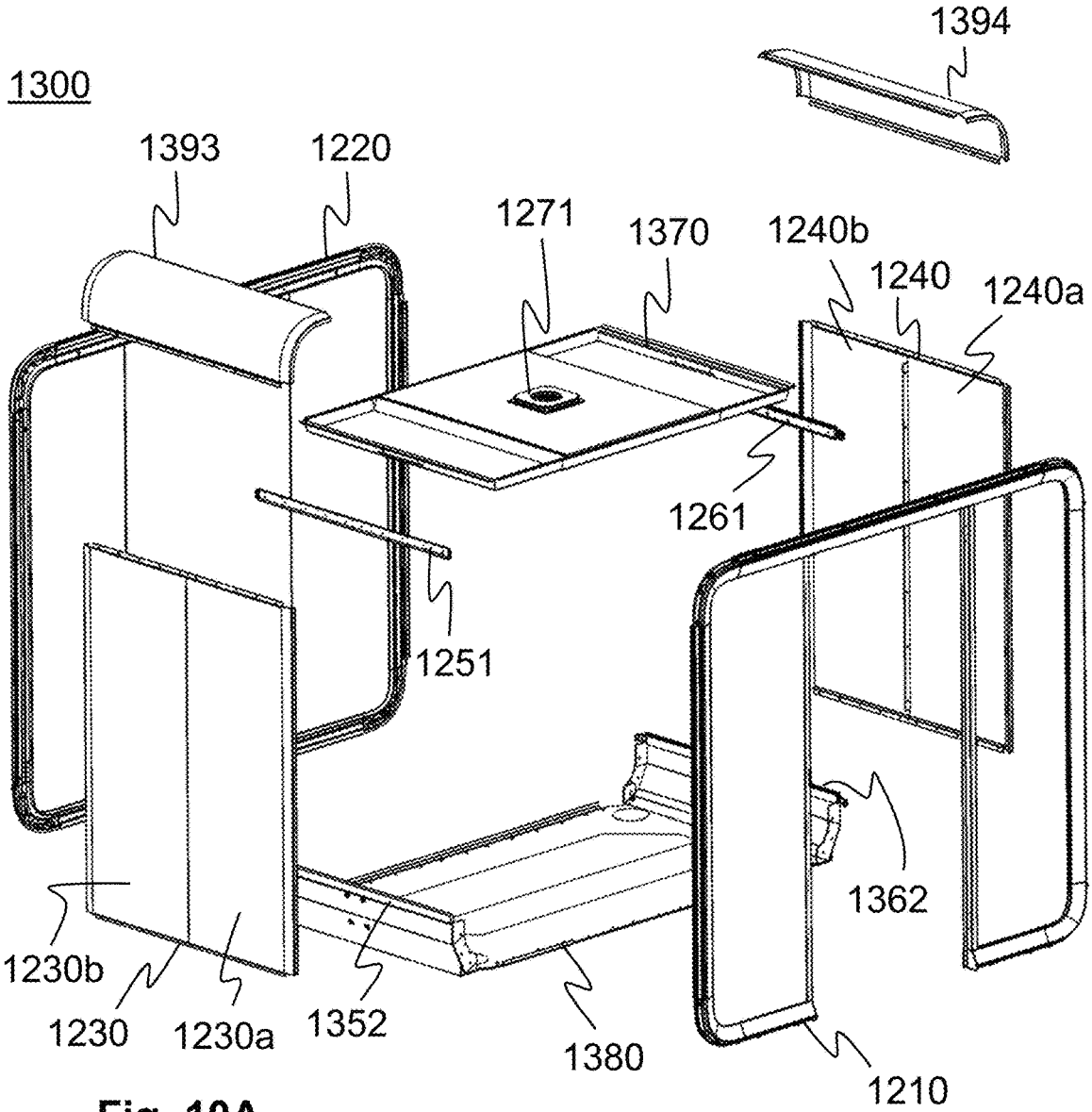
FIG. 10A shows an exploded view of parts of a larger office pod in accordance with certain embodiments.
Figure 10B:
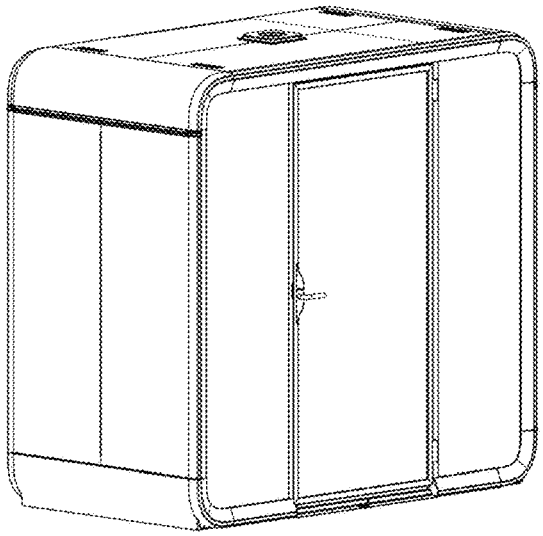
FIG. 10B shows an assembly of the office pod with parts shown in FIG. 10A.

FIG. 10A shows an exploded view of selected parts of an office pod 1300 in accordance with certain embodiments, and FIG. 10B shows an assembly of an office pod 1300 comprising parts shown in FIG. 10A. Similarly, as shown in the preceding, the office pod 1300 comprises a front load-bearing frame 1210, a rear load-bearing frame 1220, a left-hand side skin layer 1230, and a right-hand side skin layer 1240. However, compared to the office pods 100-300 described in the preceding, the office pod 1300 is a larger scale pod providing space for a plurality of persons.

In the office pod 1300, the left-hand side skin layer 1230 is attached in between the front load-bearing frame 1210 and the rear load-bearing frame 1220 at the left-hand side of the pod 1300, and the right-hand side skin layer 1240 is attached in between the front load-bearing frame 1210 and the rear load-bearing frame 1220 at the right-hand side of the pod 1300.

The left-hand side skin layer 1230 comprises an attachment point at each corner (or corner region) of the layer 1230. Similarly, the right-hand side skin layer 1240 comprises an attachment point at each corner (or corner region) of the layer 1240. The skin layers 1230, 1240 are not directly attached to the frames 1210, 1220, but there are connectors 1251, 1352, 1261, 1362 connecting the frames 1210, 1220, and the skin layers 1230, 1240 are attached to the frames 1210, 1220 via respective connectors.

In certain embodiments, the connectors 1251, 1352, 1261, and 1362 are non-vertical connectors. In certain embodiments, the connectors 1251, 1352, 1261, and 1362 are horizontal or substantially horizontal connectors. The above likewise applies to the connectors 251, 252, 261, 262, 351, 352, 361, and 362 described in the foregoing.

In the embodiments shown in FIGS. 10A and 10B, the left-hand side skin layer 1230 is attached at its top corners (or corner regions) at attachment points to a first (upper) connector 1251 attached in between the frames 1210, 1220 at the upper left-hand side of the pod 1300. Similarly, the left-hand side skin layer 1230 is attached at its lower corners (or corner regions) at attachment points to a second (lower) connector 1352 attached in between the frames 1210, 1220 at the lower left-hand side of the pod 1300.

The right-hand side skin layer 1240 is attached at its top corners (or corner regions) at attachment points to a third (upper) connector 1261 attached in between the frames 1210, 1220 at the upper right-hand side of the pod 1300. And, similarly, the right-hand side skin layer 1240 is attached at its lower corners (or corner regions) at attachment points to a fourth (lower) connector 1362 attached in between the frames 1210, 1220 at the lower right-hand side of the pod 1300.

The office pod 1300 further comprises a ceiling structure 1370 and a floor structure 1380 attached to the front load-bearing frame 1210 and to the rear load-bearing frame 1220.

In certain embodiments, the ceiling structure 1370 is configured to implement a ventilation function. For this purpose, in certain embodiments, the ceiling structure 1370 comprises an integrated ventilation system 1271.

In certain embodiments, as shown in FIGS. 10A and 10B, the office pod 1300 comprises a first corner piece 1393 positioned in between the front load-bearing frame 1210 and the rear load-bearing frame 1220 at top-left corner of the pod 1300. Similarly, a second corner piece 1394 is positioned in between the front load-bearing frame 1210 and the rear load-bearing frame 1220 at top-right corner of the pod 1300.

FIGS. 10A and 10B further show the lower connectors i.e. the second and fourth connector 1352, 1362 integrated with the floor structure 1380.

Yet further, FIGS. 10A and 10B show the left-hand side skin layer 1230 formed of two sub-pieces 1230*a* and 1230*b*. Similarly, the right-hand side skin layer 1240 is formed of two sub-pieces 1240*a* and 1240*b*.

The skin layer(s) 1230, 1240 formed of a plurality of sub-pieces (here: two sub-pieces) provide the front and rear load-bearing frames 1210, 1220 with cross-dimensional rigidity (lateral bracing). Further, in certain embodiments, the separate and connected sub-pieces 1230*a* and 1230*b* (1240*a* and 1240*b*, respectively) of the skin layers 1230, 1240 in between the frames 1210, 1220 generally are in the form of a planar, uniform surface (forming a sound stopping layer) to provide desired acoustic behaviour. By the desired acoustic behaviour is meant a drumhead-like vibrating behaviour of the sidewall (as a metaphor).

Figure 11A:
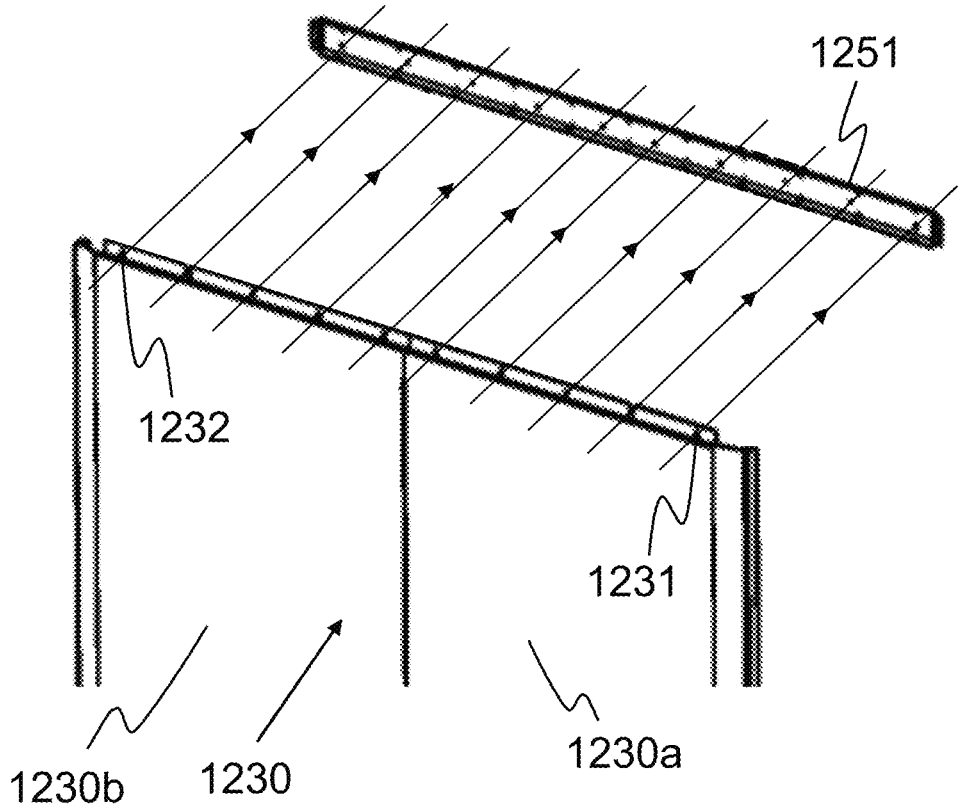
FIGS. 11A and 11B show magnifications of certain details of an office pod in accordance with certain embodiments.

FIG. 11A shows a magnification of a certain detail of the office pod 1300. Accordingly, FIG. 11A shows an optional row of attachments points in between a right-most attachment point 1231 at top-right corner (or corner region) of the left-hand side skin layer 1230 and a left-most attachment point 1232 at top-left corner (or corner region) of the left-hand side skin layer 1230. In certain embodiments, the left-hand side skin layer 1230 is attached to the first connector 1251 via these attachment points. The same equally applies to the right-hand side wall.

Figure 11B:
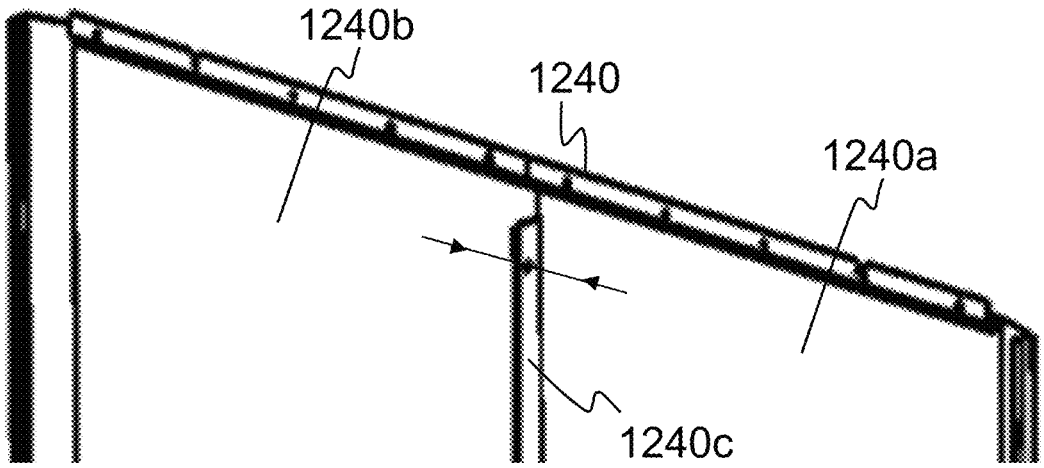

FIG. 11B shows a magnification of another detail of the office pod 1300. Accordingly, FIG. 11B shows the right-hand side skin layer 1240 formed of sub-pieces 1240*a*, 1240*b* and a stiffening arrangement 1240*c* at a joining point or region of the sub-pieces 1240*a*, 1240*b*. The stiffening arrangement (or shape) 1240*c* in the middle provides the sidewall with anti-bulging support in the event a person is leaning against the sidewall (without deteriorating the desired acoustic behaviour). The same equally applies to the left-hand side wall.

Figure 12:
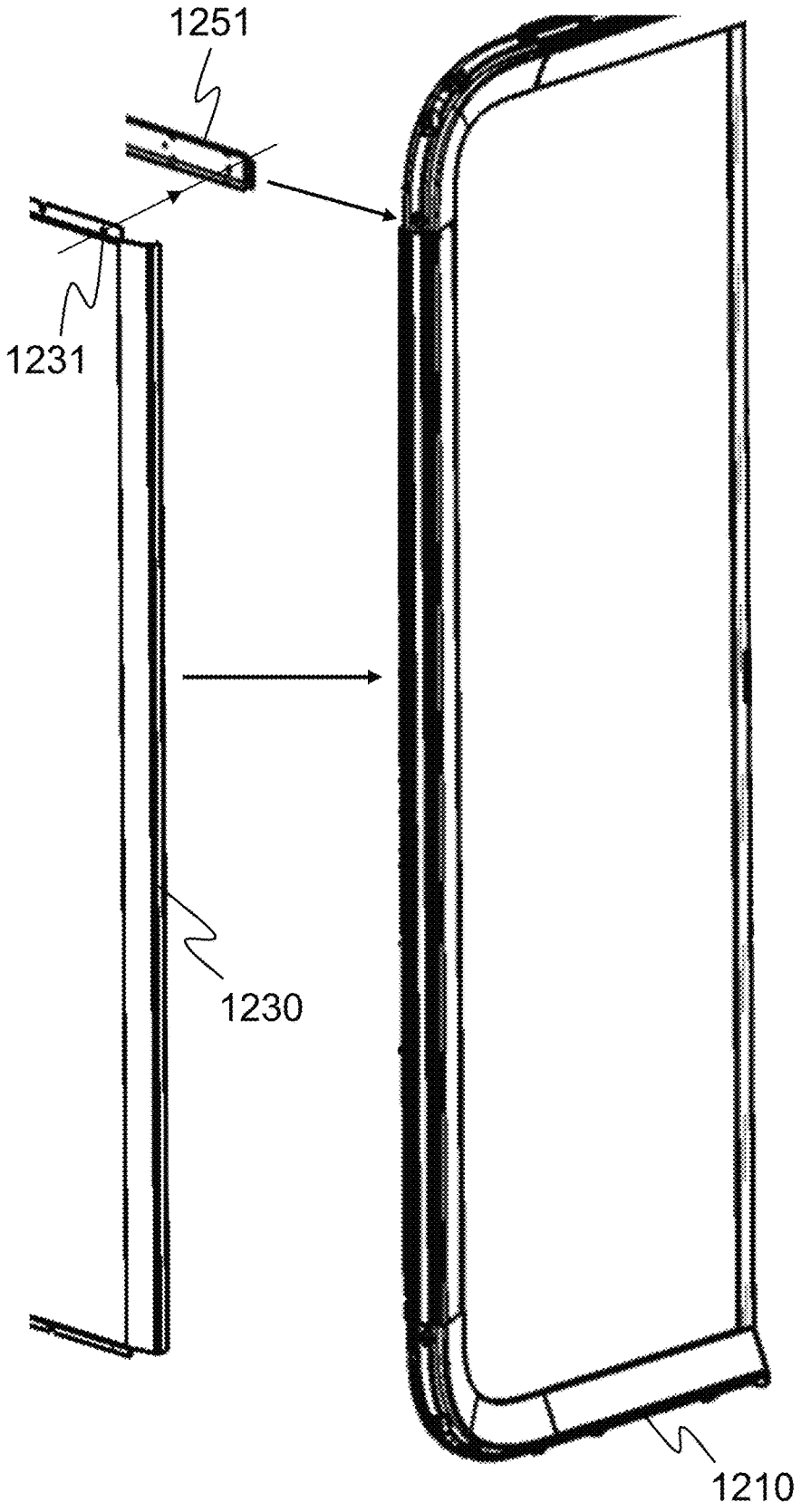
FIG. 12 shows a magnification of yet another detail of an office pod in accordance with certain embodiments.

FIG. 12 shows a magnification of yet another detail of the office pod 1300. Accordingly, FIG. 12 shows the left-hand side skin layer 1230 to be attached to the first connector 1251 at the right-most attachment point 1231 at top-right corner (or corner region) of the left-hand side skin layer 1230, and the first connector 1251 to be attached to the front load-bearing frame 1210 so that the left-hand side skin layer 1230 sets onto the front load-bearing frame 1210. The same equally applies to the right-hand side wall.

Figure 13:
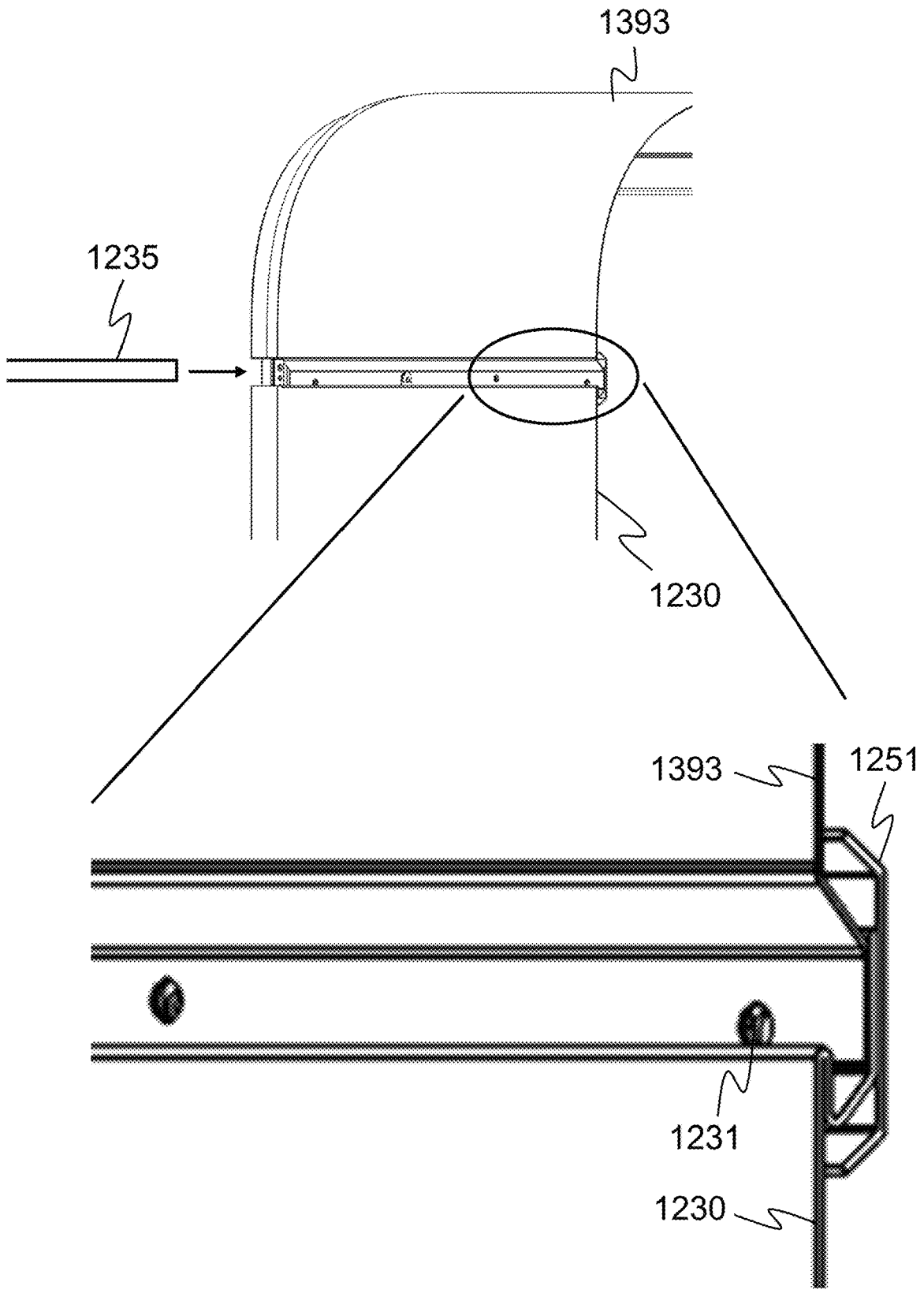
FIG. 13 shows a magnification of yet another detail of an office pod in accordance with certain embodiments.

FIG. 13 shows a magnification of yet another detail of the office pod 1300. Accordingly, FIG. 13 shows the left-hand side skin layer 1230 attached to the first connector 1251 at the right-most attachment point 1231 at top-right corner (or corner region) of the left-hand side skin layer 1230. FIG. 13 further shows the first corner piece 1393 attached to the left-hand side skin layer 1230 at the same attachment point 1231. In certain embodiments, as shown in FIG. 13, the left-hand side skin layer 1230 and an end portion of the first corner piece 1393 are bent so that they overlap each other. Further, in certain embodiments, the bent parts form a pocket for receiving an add-on rail 1235 (schematically illustrated) for providing a system for attaching additional parts or accessories to the pod, such as a shelve, a desktop table or a whiteboard. The same equally applies to the right-hand side wall.

Figure 14:
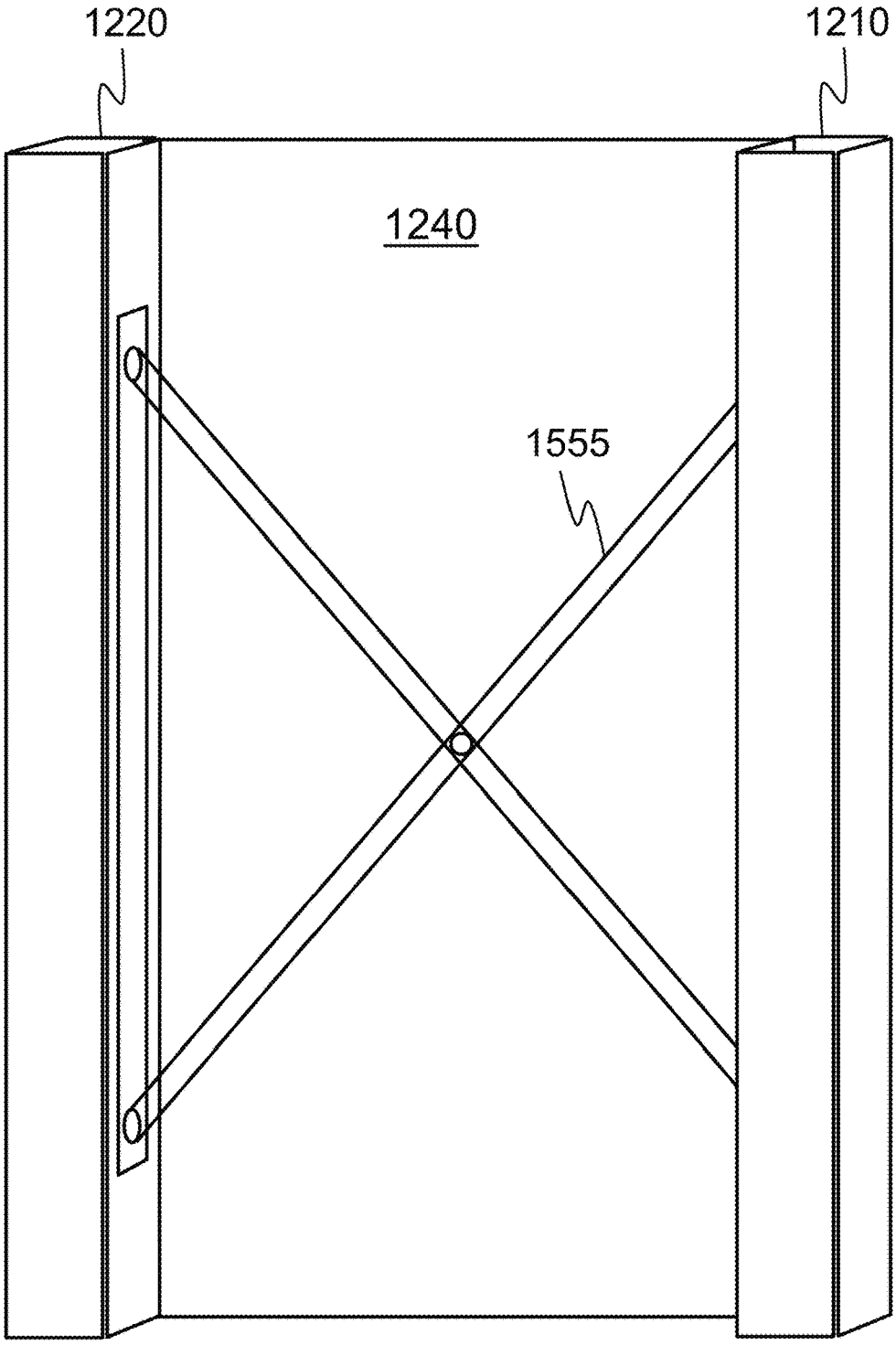
FIG. 14 shows a further detail of an office pod in accordance with certain embodiments.

FIG. 14 shows a further detail of the office pod 1300 in accordance with certain embodiments. In these embodiments, the office pod 1300 comprises an optional cross brace 1555 in between the front load-bearing frame 1210 and the rear load-bearing frame 1220. This additional cross brace 1555 is positioned within the wall structure behind the skin layer 1240 (when approaching the interior of the pod 1300 from the outside). The purpose of the cross brace 1555 is to provide the sidewall in question with anti-bulging support in the event a person is leaning against the sidewall from the inside of the office pod. The actual structure of the cross brace 1555 depends on the implementation.

Figure 15:
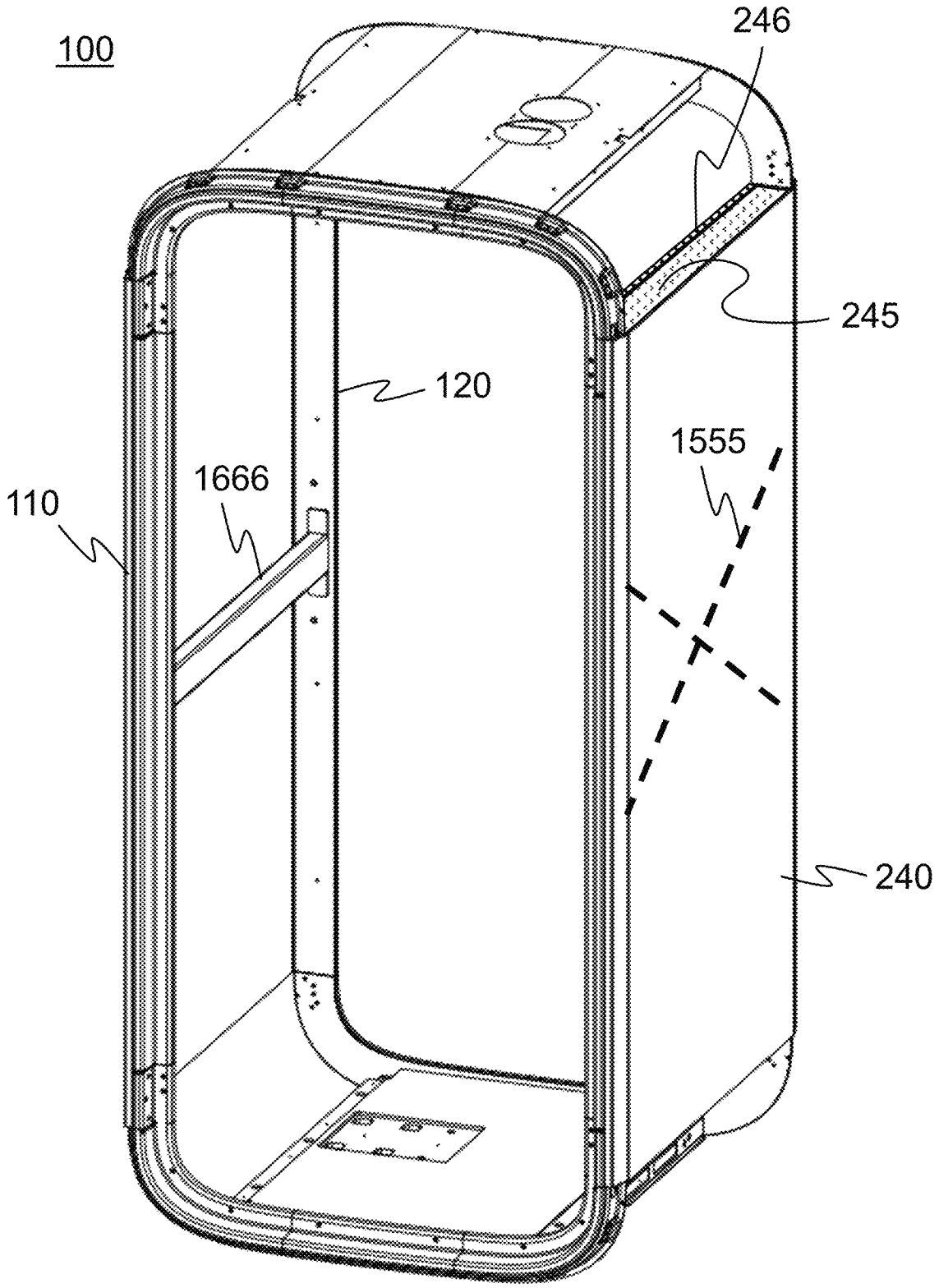
FIG. 15 show a cross brace and certain sound absorbing layers in an office pod in accordance with certain embodiments.

FIG. 15 shows a similar cross brace 1555 in the office pod 100. FIG. 15 further shows the first and second sound absorbing layers 245, 246 behind the right-hand side skin layer 240. FIG. 15 further shows a hollow bar 1666 attached in between the front load-bearing frame 110 and the rear load-bearing frame 120. In certain embodiments, the hollow bar 1666 does not provide cross-dimensional rigidity (however, in other embodiments it may provide cross-dimensional rigidity) but accommodates mains voltage electric components within the pod structure and to provide attachment for a work surface (not shown). In certain embodiments, the hollow bar provides a fire enclosure for mains voltage electric components of the pod thereby eliminating a need for a separate fire enclosure for mains voltage electric components. When serving as such a fire enclosure, the hollow bar is made of incombustible material such as of metal, preferably steel, or flame-retardant plastic, preferably 5VA plastic.

Figure 16:
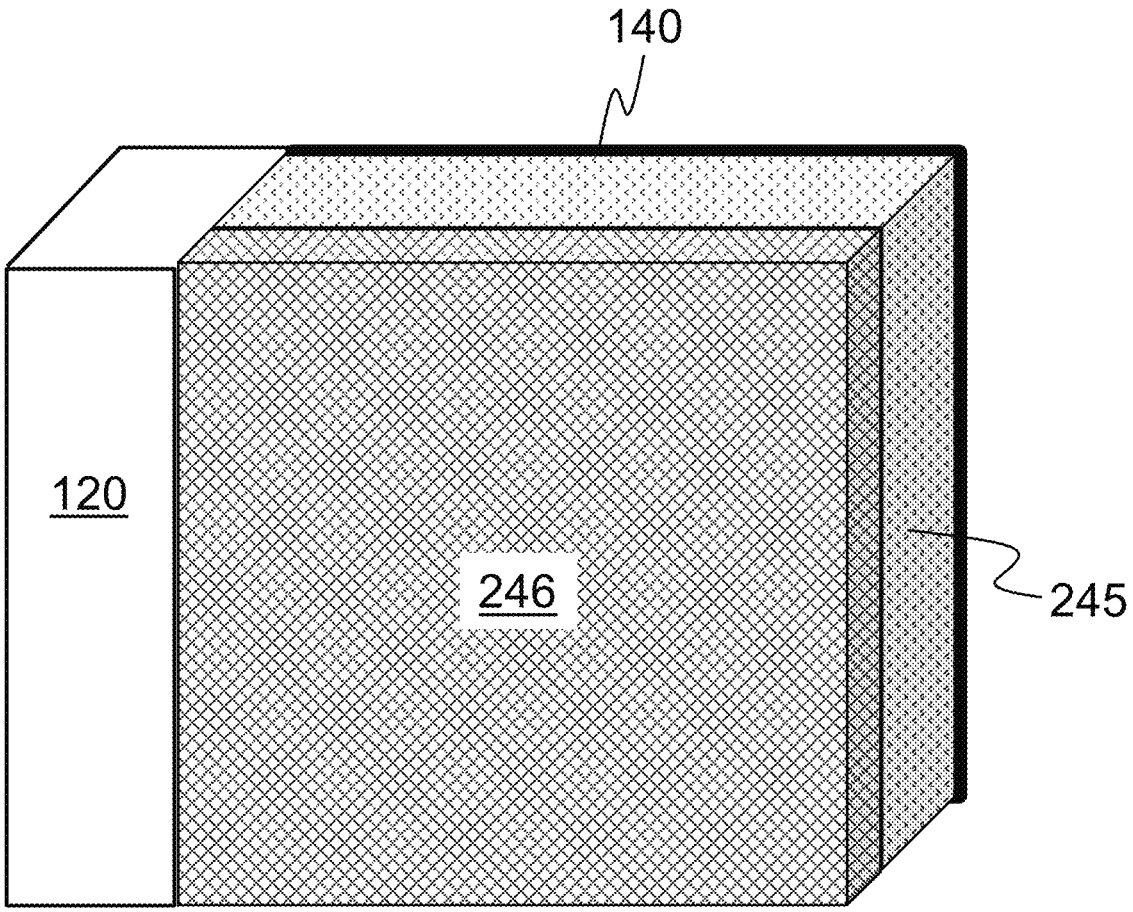
FIG. 16 shows certain layers of a sidewall structure of an office pod in accordance with certain embodiments.

FIG. 16 shows a three-dimensional partial illustration of the right-hand side skin layer 140, the first sound absorbing layer 245 and the inner liner 246 touching the rear load-bearing frame 120.

Figure 17:
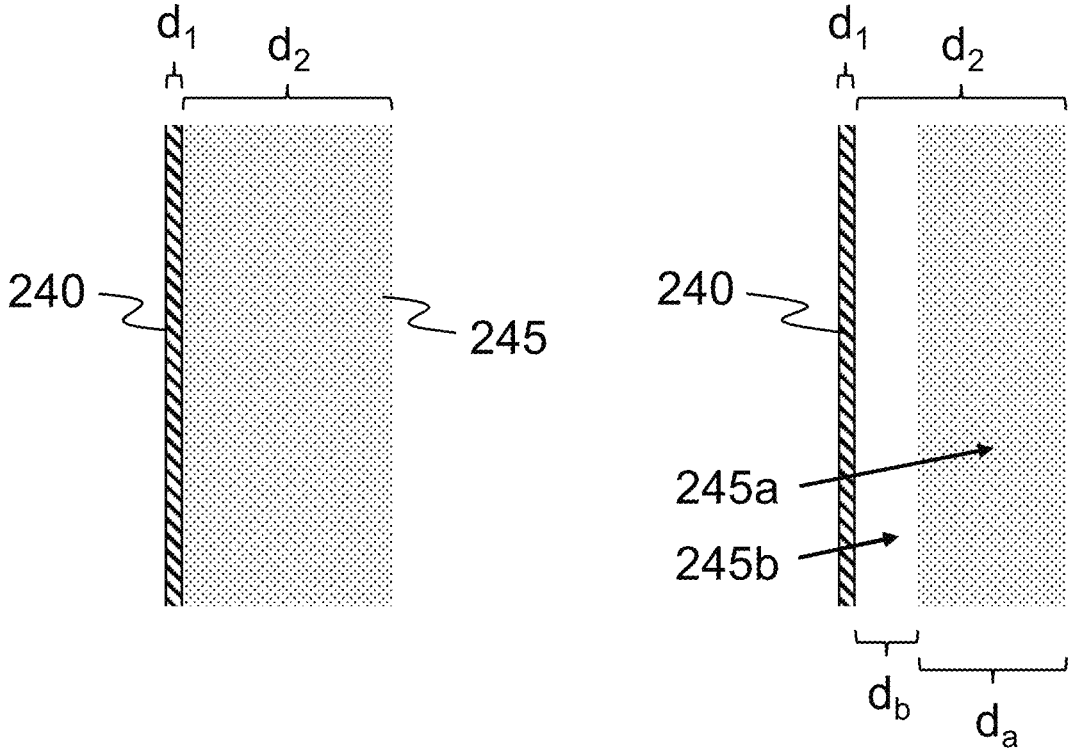
FIG. 17 shows a cross-sectional view of a sidewall structure of an office pod in accordance with certain embodiments.

FIG. 17 shows an aspect of an office pod enclosing a soundproof workspace inside of the pod and comprising a front load-bearing frame, a rear load-bearing frame, and a cross-dimensional rigidity providing skin layer attached in between the front and rear load-bearing frames, and further comprising a sound absorbing layer following the skin layer. Accordingly, the office pod is of the type shown in the preceding description and drawings. However, in other embodiments, the FIG. 17 merely presents a soundproofing wall structure, such as a sidewall structure, of any office pod enclosing a soundproof workspace inside of the pod. FIG. 17 shows a cross-sectional view of the (side)wall structure of the pod comprising a skin layer 240, and a sound absorbing layer 245 next to the skin layer 240. The skin layer is of metal (such as a sheet of steel) or of other sound stopping material. In a first alternative, as shown in the left-most drawing of FIG. 17 the skin layer 240 has a thickness of $d_1$ and the sound absorbing layer 245 has a thickness of $d_2$. In a second alternative, as shown in the right-most drawing of FIG. 17 the skin layer 240, again, has the thickness of $d_1$ and a sound absorbing element containing a sound absorbing material layer 245*a* with a thickness of $d_a$ and an air layer 245*b* with a thickness of $d_b$ has the (total) thickness of $d_2$.

In a structure in which a (sound stopping) skin layer is followed by a sound absorbing element, it has been observed that the properties of the different layers play an important role in the propagation and attenuation of sound within the structure. It has been observed that it is advantageous to select the coincidence frequency of the skin layer to remain outside of a predetermined human speech frequency region. In certain embodiments, for feasibility of technical implementation in the wall of an office pod, it is advantageous that the coincidence frequency is above the above-mentioned frequency (region).

In certain embodiments, the coincidence frequency of the skin layer is above said predetermined human speech frequency region so as to improve a sound stopping effect at human speech frequencies.

In certain embodiments, the office pod comprises said skin layer having a coincidence frequency outside of said predetermined human speech frequency region defined based on frequencies at which human speech has the greatest intensity.

In certain embodiments, said predetermined human speech frequency region is defined based on frequencies at which human speech carries the most information in a spoken content.

In certain embodiments, the office pod comprises said skin layer having a coincidence frequency outside of said predetermined human speech frequency region defined based on human speech frequency (or frequencies) which has the greatest intensity and/or carries the most information in spoken content.

In certain embodiments, considering the above, it has been observed that it is advantageous if the coincidence frequency is above 5 kHz, more preferably above 8 kHz. The coincidence frequency $f_c$ in certain embodiments is defined based on the following equation $$f_c = \frac{c^2}{2\pi}\sqrt{\frac{12\rho_A(1-\upsilon)^2}{Ed_1^3}}$$

where c is the velocity of sound, $\rho_A$ is the area density of the skin layer, v is the Poisson number, and E is the Young's modulus of the skin layer.

Figure 18:
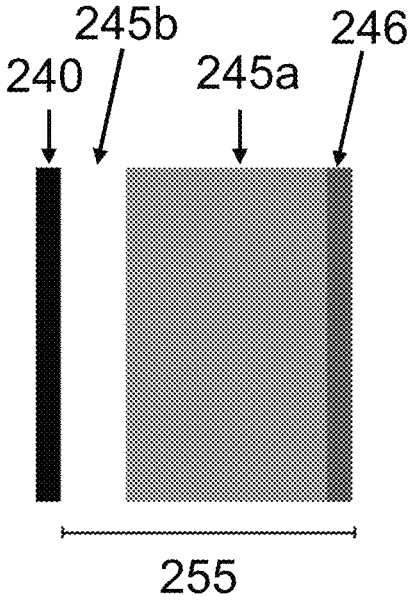
FIG. 18 shows a further cross-sectional view of a sidewall structure of an office pod in accordance with certain embodiments.

FIG. 18 shows a further cross-sectional view of a wall structure of an office pod in accordance with certain embodiments. Therein the skin layer 240 is followed by a sound absorbing element 255. The purpose of the sound absorbing element 255 is to absorb sound from inside the pod (1) before the sound reaches the skin layer 240; and (2) after the sound has reached the skin layer 240 and has been reflected back.

The sound absorbing element 255 consists of at least of fluffy sound absorbing material (sound absorbing material layer 245*a*). Porous and open-cell materials represent applicable sound absorbing material types. A specific example of applicable materials is for example Ewona fiber mat or similar. In certain embodiments, the fluffy sound absorbing material is of dustproof material. In certain embodiments, the flow resistivity of the fluffy sound absorbing material is below 100 kPas/m$^2$ so as to prevent echo (sound reflecting back from the sound absorbing material), but a preferred area of flow resistivity as to sound absorbing extends from 4 to 30 kPas/m$^2$, more preferably from 5 to 15 kPas/m$^2$.

Optionally, the sound absorbing element 255 comprises:

An inner liner layer 246. This layer is an inner layer facing the user of the pod. In certain embodiments, the inner liner layer 246 is of more robust and/or dense material compared to the material of the sound absorbing material layer 245*a* so as to provide a durable inner surface for the pod interior, to provide a more rigid surface against leaning, and to provide a finalized pod interior surface for the user. However, such an inner liner 246 with a higher flow resistivity should be porous enough to prevent echo formation (i.e. not reflect back sound to a degree disturbing for a human conversationalist). Accordingly, the flow resistivity of the inner liner layer 246 is preferably below 100 kPas/m$^2$, more preferably below 40 kPas/m$^2$. When the sound absorbing element comprises the more robust and/or dense inner liner layer 246, the sound absorbing material behind the inner liner layer 246 may be of fluffy material of lower flow resistivity. In this way, the use of the inner liner layer 246 enables the use of a material with a lower flow resistivity behind it. In certain embodiments, the thickness of the inner liner layer 246 is preferably at most 20%, or more preferably at most 10% of the thickness of the (fluffy) sound absorbing material layer 245*a*.

An air layer (air gap) 245*b*. The air layer 245*b* may be on either side of the (fluffy) sound absorbing material layer 245*a*, or there may be more air layers. However, preferably the total thickness of the air layer(s) is less than half of the total thickness of the layered sound absorbing element 255.

Figure 19:
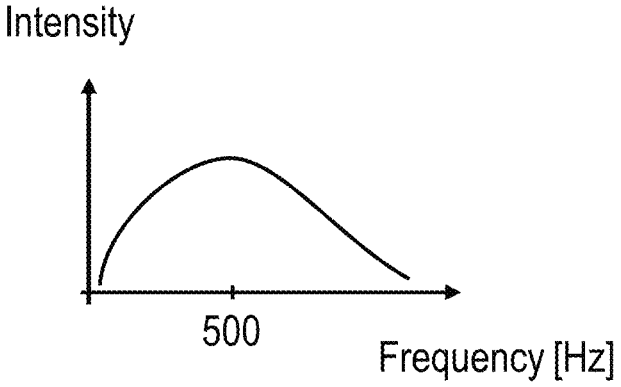
FIG. 19 shows a rough illustration of a typical spectrum of human speech intensity.

It has been observed that the human speech has its highest intensity around the frequency of 500 Hz (see illustrative FIG. 19). Accordingly, in certain embodiments, the sound absorbing element has a total thickness greater than ⅛ of the wavelength of human speech at the frequency of 500 Hz. Taking this into account, it is advantageous if the total thickness of the sound absorbing element is 50 mm or more, or more preferably 85 mm or more. However, simultaneously, in order for the wall structure itself to occupy little volume in the space in which it is used, the maximum thickness for the wall structure as a whole is 200 mm, more preferably 100 mm. Accordingly, in certain embodiments, the total thickness of the wall structure is less than 200 mm, more preferably less than 100 mm. Further, in certain preferable embodiments, the total thickness of the wall structure is less than 150 mm.

In certain embodiments, the flow resistivity of the sound absorbing element is within the range extending from 4 to 30 kPas/m$^2$ (kilopascal seconds per square meter) more preferably from 5 to 15 kPas/m$^2$. In any event, the flow resistivity of the sound absorbing layer is at maximum 100 kPas/m$^2$, preferably at maximum 40 kPas/m$^2$, to avoid unwanted sound reflections, especially in consonants in human speech, from the sound absorbing layer, which could be detrimental to the acoustic experience of a user using the office pod. Such a maximum is especially applicable in case there is the inner liner layer 246 facing the pod interior wherein the inner liner has a higher flow resistivity than the other material layer(s) of the sound absorbing element 255.

In certain embodiments, the flow resistivity of the inner liner 246 is at maximum of 100 kPas/m$^2$, more preferably at maximum of 40 kPas/m$^2$, and the flow resistivity of other material layer(s) or each of the other material layer(s) of the sound absorbing element is within the range extending from 4 kPas/m$^2$ to 30 kPas/m$^2$, more preferably from 5 kPas/m$^2$ to 15 kPas/m$^2$.

In certain embodiments, the thickness of the sound absorbing element 255 is greater than ⅛ of the wavelength of human speech at the frequency of 500 Hz, and the flow resistivity of the sound absorbing element 255 fall within the range extending from 4 to 30 kPas/m$^2$, in more preferred embodiments from 5 to 15 kPas/m$^2$. In certain preferred embodiments, the thickness of the sound absorbing element 255 is 85 mm or greater and the flow resistivity of the sound absorbing element 255 falls within the range extending from 4 to 30 kPas/m$^2$, more preferably from 5 to 15 kPas/m$^2$.

As an example of a wall structure, specifically designed for (but not limited to) smaller pods, such as a single user pod, the office pod comprises:

Steel with a thickness 1.0-1.5 mm as a skin layer

PET (Polyethylene terephthalate) fiber with a thickness of 50-80 mm and a density of 15-50 kg/m$^3$, preferably 15-25 kg/m$^3$, as a sound absorbing layer PET- or PES-based (Poly(ethylene succinate)) felt with a thickness of 2-12 mm and a density of 200-250 kg/m$^3$ as an inner liner layer, optionally comprising a textile fabric as the innermost (user-facing) coating.

As another example of a wall structure, specifically designed for (but not limited to) larger scale pods, the office pod comprises:

Steel with a thickness 1.0-2.0 mm as a skin layer

PET fiber with a thickness of 50-90 mm and a density of 15-50 kg/m$^3$, preferably 20-30 kg/m$^3$, as a sound absorbing layer PET- or PES-based felt with a thickness of 2-12 mm and a density of 200-250 kg/m$^3$ as an inner liner layer, optionally comprising a textile fabric as the innermost (user-facing) coating.

Figure 20:
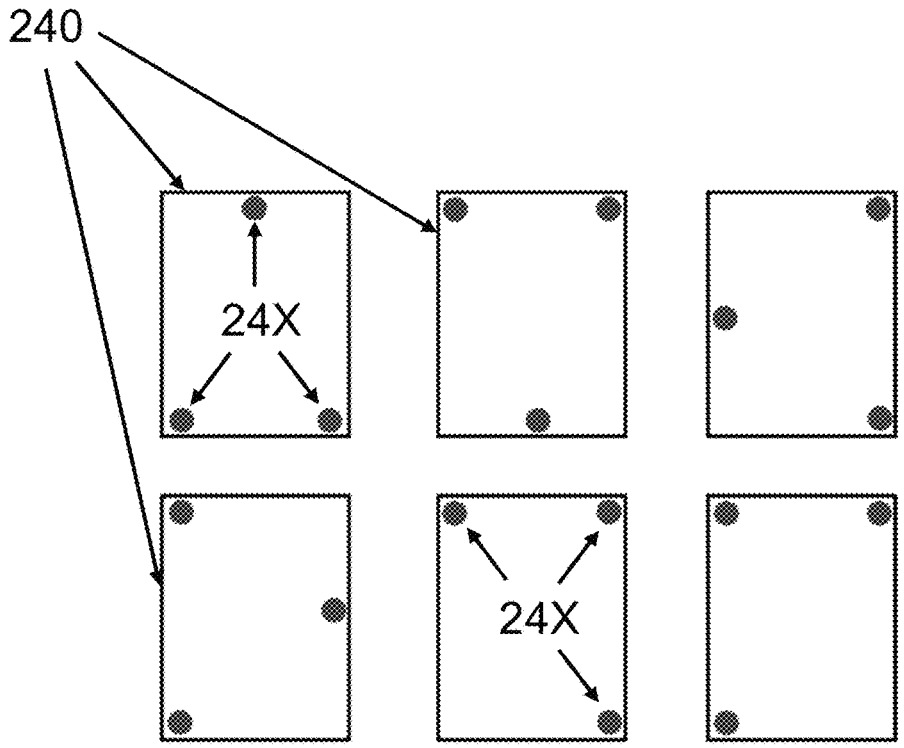
FIG. 20 shows positions of attachment points for a single piece skin layer in accordance with certain embodiments.

FIG. 20 shows positions of attachment points for a single piece skin layer (for example skin layer 240) in accordance with certain embodiments. In order to provide cross-dimensional rigidity, the skin layer 240 in certain embodiments comprises at least three attachment points 24X at peripheral regions of the skin layer. FIG. 20 shows certain alternatives of their positioning.

Figure 21:
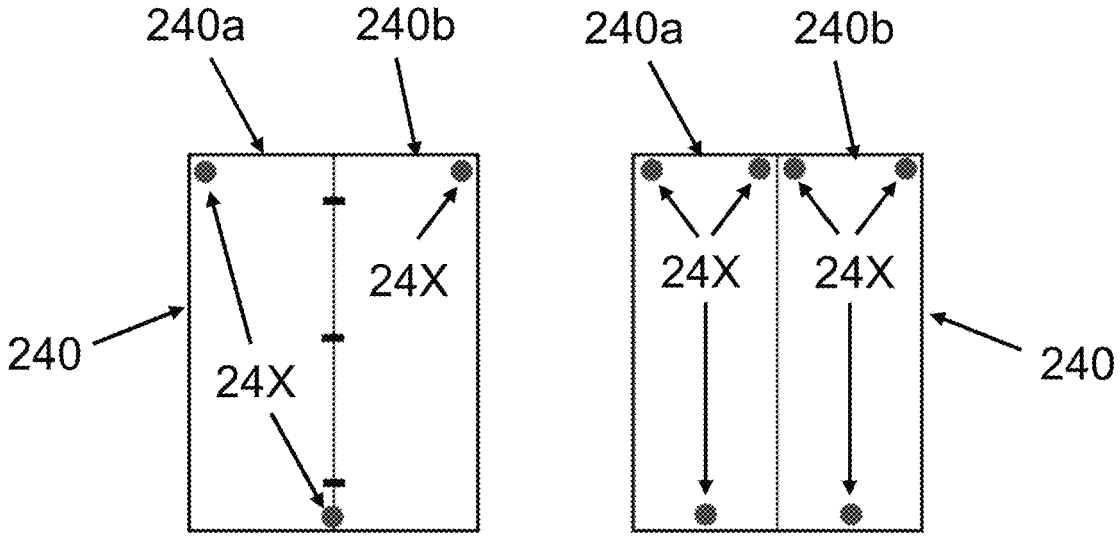
FIG. 21 shows positions of attachment points for a skin layer formed of a plurality of sub-pieces in accordance with certain embodiments.

FIG. 21 shows positions of attachment points for a skin layer formed of a plurality of sub-pieces (here: two sub-pieces 240*a* and 240*b*) in accordance with certain embodiments. In embodiments, in which the sub-pieces are joined with each other (left-most drawing), through stiffening arrangements of similar, the skin layer (combination) 240 comprises at least three attachment points 24X at peripheral regions of the skin layer 240. If the sub-pieces 240*a*, 240*b* are not joined with each other (so that the sub-pieces 240*a* and 240*b* can move in relation to each other) the requirement of at least three attachment points (as shown in the preceding in connection with FIG. 20) apply separately for both sub-pieces (right-most drawing).

In certain embodiment, instead of three attachment points, four or more attachment points are implemented.

Various embodiments have been presented. It should be appreciated that in this document, words "comprise", "include", and "contain" are each used as open-ended expressions with no intended exclusivity.

Without limiting the scope and interpretation of the patent claims, certain technical effects of one or more of the example embodiments disclosed herein are listed in the following. A technical effect is a lighter office pod structure compared to conventional pods formed of heavy modular sidewall structures and yet achieving good soundproofing properties, particularly at human speech frequency range. Another technical effect is easier and more simple pod assembly due to simplified structure containing fewer parts and/or material layers. Another technical effect is more economical pod manufacturing due to savings in raw material. Another technical effect is a enabling a thin wall structure, suitable for office pod use, which provides as good soundproofing properties, particularly at human speech frequency range, as previously known thicker wall structures. Another technical effect is more environmentally friendly yet well soundproofing office pod and/or wall structure due to decreased material consumption as well as decreased energy consumption in logistics due to smaller and less heavy shipments. Another technical effect is to provide a wall structure or an office pod with a wall structure with minimal health hazards during construction, assembly and/or use. Another technical effect is to provide an office pod without corner posts or pillars for ease of assembly and/or enhanced rigidity. Another technical effect is achieving two or more of the above-mentioned effects simultaneously.

The foregoing description has provided by way of non-limiting examples of particular implementations and embodiments a full and informative description of the best mode presently contemplated by the inventors for carrying out the present disclosure. It is however clear to a person skilled in the art that the present disclosure is not restricted to details of the embodiments presented in the foregoing, but that it can be implemented in other embodiments using equivalent means or in different combinations of embodiments without deviating from the characteristics of the present disclosure.

Furthermore, some of the features of the afore-disclosed example embodiments may be used to advantage without the corresponding use of other features. As such, the foregoing description shall be considered as merely illustrative of the principles of the present disclosure, and not in limitation thereof. Hence, the scope of the present disclosure is only restricted by the appended patent claims.

The invention claimed is:

1. An office pod enclosing a soundproof workspace inside of the pod, comprising:

a wall structure formed of a sound absorbing element and a skin layer, said skin layer forming an exterior surface of the office pod followed by the sound absorbing element facing an interior of the office pod, wherein the skin layer has a coincidence above 5 kHz, wherein the sound absorbing element comprises a first sound absorbing material layer and a second sound absorbing material layer, and wherein the flow resistivity of the second sound absorbing material layer is higher than the flow resistivity of the first sound absorbing material layer.

2. The office pod of claim 1, wherein said coincidence frequency is above 8 kHz.

3. The office pod of claim 1, wherein the skin layer is only sound stopping layer in the wall structure.

4. The office pod of claim 1, wherein the sound absorbing element has a total thickness greater than ⅛ of the wavelength of human speech at the frequency of 500 Hz.

5. The office pod of claim 1, wherein the second sound absorbing material layer is closer to the interior of the office pod and forms an inner liner layer.

6. The office pod of claim 1, comprising at least one air layer in between the skin layer and the sound absorbing element.

7. The office pod of claim 6, wherein the total thickness of the air layer(s) is less than half of the total thickness of the sound absorbing element.

8. The office pod of claim 1, wherein the sound absorbing element has an overall flow resistivity below 100 kPas/$m^2$.

9. The office pod of claim 5, wherein the first sound absorbing material layer has a flow resistivity within the range extending from 4 to 30 kPas/$m^2$, and the second sound absorbing material layer has a flow resistivity at maximum of 100 kPas/$m^2$.

10. The office pod of claim 1, wherein the sound absorbing element is of dustproof material(s).

11. The office pod of claim 1, wherein the total thickness of the wall structure is less than 200 mm.

12. The office pod of claim 1, comprising the skin layer attached to load-bearing support structures of the office pod so as to provide the support structures with cross-dimensional rigidity.

13. A soundproofing wall structure for an office pod, the wall structure being formed of a sound absorbing element and a skin layer, said skin layer, when arranged to the office pod, forming an exterior surface of the office pod followed by the sound absorbing element facing an interior of the office pod, wherein the skin layer has a coincidence frequency above 5 kHz, wherein the sound absorbing element comprises a first sound absorbing material layer and a second sound absorbing material layer, and wherein the flow resistivity of the second sound absorbing material layer is higher than the flow resistivity of the first sound absorbing material layer.

* * * * *